US009757604B2

(12) United States Patent
Carter

(10) Patent No.: US 9,757,604 B2
(45) Date of Patent: Sep. 12, 2017

(54) MULTIPURPOSE EXERCISE TRAINING DEVICE

(71) Applicant: Matthew Roderick Carter, San Diego, CA (US)

(72) Inventor: Matthew Roderick Carter, San Diego, CA (US)

( * ) Notice: Subject to any disclaimer, the term of this patent is extended or adjusted under 35 U.S.C. 154(b) by 0 days.

(21) Appl. No.: 14/937,114

(22) Filed: Nov. 10, 2015

(65) Prior Publication Data

US 2017/0050065 A1 Feb. 23, 2017

Related U.S. Application Data

(60) Provisional application No. 62/206,274, filed on Aug. 18, 2015.

(51) Int. Cl.
*A63B 5/20* (2006.01)
*A63B 21/068* (2006.01)
(Continued)

(52) U.S. Cl.
CPC ..... *A63B 5/20* (2013.01); *A63B 21/068* (2013.01); *A63B 21/151* (2013.01); *A63B 21/16* (2013.01);
(Continued)

(58) Field of Classification Search
CPC ... A63B 5/20; A63B 2208/12; A63B 21/4035; A63B 2210/50; A63B 21/0004;
(Continued)

(56) References Cited

U.S. PATENT DOCUMENTS 554,992 A * 2/1896 Donnellan ..... A63B 5/20 24/299
623,698 A * 4/1899 Beckh ..... A63B 5/20 482/82
(Continued)

FOREIGN PATENT DOCUMENTS

CA 2628774 7/2007
CA 2699777 3/2009
(Continued)

*Primary Examiner* — Sundhara Ganesan
*Assistant Examiner* — Andrew S Lo
(74) *Attorney, Agent, or Firm* — Buche & Associates, P.C.; John K. Buche; Bryce A. Johnson

(57) ABSTRACT

An exercise device having many advantageous features is described, including the ability to provide users with multiple modes of training by transforming the device into different configurations. Users can exercise their cardiovascular endurance by using the device in its jump rope configuration. Users can also engage in muscular resistance training using the same device configured to one of multiple possible resistance training configurations. Resistance training configurations provide a method of suspending users' bodyweight such that they can train their muscular strength capacity by exerting themselves against the force of gravity. Resistance can be selected from nearly zero resistance to a user's full body weight, with the ability to easily adjust between exercises and between users, and the ability to easily transform the device between configurations to provide for versatility and ease-of-use. The device includes an inelastic length member with two clip assemblies and two handles and/or grips at both ends.

12 Claims, 22 Drawing Sheets

(51) Int. Cl.

| | |
|---|---|
| ***A63B 21/00*** | (2006.01) |
| ***A63B 21/16*** | (2006.01) |
| ***A63B 23/12*** | (2006.01) |
| ***B25G 1/04*** | (2006.01) |
| *A63B 21/04* | (2006.01) |
| *A63B 21/055* | (2006.01) |
| *A63B 23/02* | (2006.01) |
| *A63B 69/00* | (2006.01) |
| *A63B 21/072* | (2006.01) |

(52) U.S. Cl.
CPC ..... *A63B 21/4035* (2015.10); *A63B 23/1209* (2013.01); *B25G 1/04* (2013.01); *A63B 21/00043* (2013.01); *A63B 21/00061* (2013.01); *A63B 21/00065* (2013.01); *A63B 21/0442* (2013.01); *A63B 21/0557* (2013.01); *A63B 21/072* (2013.01); *A63B 21/4013* (2015.10); *A63B 21/4034* (2015.10); *A63B 21/4043* (2015.10); *A63B 23/0233* (2013.01); *A63B 23/1218* (2013.01); *A63B 23/1227* (2013.01); *A63B 69/0048* (2013.01); *A63B 2209/08* (2013.01); *A63B 2225/09* (2013.01)

(58) Field of Classification Search
CPC ..... A63B 21/4043; A63B 2225/09; A63B 21/00061; A63B 21/0552; A63B 21/0557; A63B 21/06; A63B 21/4017; A63B 21/4019; A63B 21/00043; A63B 43/007; A63B 2023/006; A63B 2071/027; A63B 21/00185; A63B 21/151; A63B 2208/0204; A63B 2209/00; A63B 2209/02; A63B 69/0088
USPC ..... 482/81–82
See application file for complete search history.

(56) References Cited

U.S. PATENT DOCUMENTS

| | | | | | |
|---|---|---|---|---|---|
| 2,723,121 | A * | 11/1955 | Cartwright | A63B 5/20 | 24/129 R |
| 4,018,441 | A | 4/1977 | Greenberg | | |
| 4,157,827 | A * | 6/1979 | Winston | A63B 23/16 | 482/139 |
| 4,293,125 | A * | 10/1981 | Hinds | A63B 5/20 | 273/DIG. 1 |
| 4,505,474 | A * | 3/1985 | Mattox | A63B 5/20 | 482/110 |
| 4,529,195 | A * | 7/1985 | Stevens | A63B 5/20 | 482/1 |
| 4,563,002 | A * | 1/1986 | Jardine | A63B 5/20 | 482/82 |
| 4,637,606 | A * | 1/1987 | Hunn | A63B 5/20 | 482/82 |
| 4,733,861 | A * | 3/1988 | Plunkett, III | A63B 21/0004 | 482/122 |
| 5,620,397 | A | 4/1997 | Chieh | | |
| 5,643,149 | A * | 7/1997 | Grimaldi | A63B 5/20 | 482/122 |
| 5,842,956 | A | 12/1998 | Strachan | | |
| 6,398,694 | B1 * | 6/2002 | Bountourakis | A63B 21/00069 | 482/109 |
| 6,398,698 | B1 * | 6/2002 | Hinds | A63B 21/0004 | 482/124 |
| 6,524,226 | B2 * | 2/2003 | Kushner | A63B 21/0004 | 482/126 |
| 6,540,649 | B1 | 4/2003 | Niedrich | | |
| 6,544,148 | B1 * | 4/2003 | Loew | A63B 21/0728 | 482/82 |
| 6,672,997 | B1 * | 1/2004 | Winkler | A63B 21/0552 | 482/121 |
| 6,887,188 | B1 * | 5/2005 | Davies | A63B 5/20 | 446/247 |
| 7,044,896 | B2 | 5/2006 | Hetrick | | |
| 7,090,622 | B2 | 8/2006 | Hetrick | | |
| 7,217,227 | B2 | 5/2007 | Finn | | |
| 7,354,383 | B2 | 4/2008 | Bardha | | |
| 7,503,883 | B2 | 3/2009 | Madden | | |
| 7,651,448 | B2 | 1/2010 | Hetrick | | |
| 7,762,932 | B2 | 7/2010 | Hetrick | | |
| 7,785,244 | B2 | 8/2010 | Hetrick | | |
| 7,794,369 | B1 | 9/2010 | Rivera | | |
| 7,806,814 | B2 | 10/2010 | Hetrick | | |
| 8,043,197 | B2 | 10/2011 | Hetrick | | |
| 8,197,392 | B2 | 6/2012 | Silverman et al. | | |
| 8,602,952 | B1 | 12/2013 | Cruz | | |
| 2002/0052270 | A1 * | 5/2002 | Hinds | A63B 21/0004 | 482/126 |
| 2007/0027005 | A1 | 2/2007 | Hetrick | | |
| 2010/0116761 | A1 * | 5/2010 | Wagner | A47F 5/137 | 211/60.1 |
| 2011/0306474 | A1 | 12/2011 | Gamboa et al. | | |
| 2012/0329618 | A1 | 12/2012 | White et al. | | |
| 2013/0165299 | A1 * | 6/2013 | Hunt | A63B 5/20 | 482/82 |
| 2013/0165301 | A1 * | 6/2013 | Thrasher-Rudd | A63B 7/00 | 482/129 |
| 2013/0217547 | A1 * | 8/2013 | Hinds | A63B 7/00 | 482/96 |
| 2014/0228180 | A1 | 8/2014 | Walker | | |
| 2014/0274569 | A1 * | 9/2014 | Lewen | A63B 7/02 | 482/24 |
| 2014/0329650 | A1 | 11/2014 | Watry | | |
| 2014/0336016 | A1 * | 11/2014 | Hernendez | A63B 21/4043 | 482/93 |
| 2014/0342883 | A1 * | 11/2014 | Joost | A63B 21/0442 | 482/129 |
| 2015/0089775 | A1 * | 4/2015 | Baldwin | A63B 67/10 | 24/302 |
| 2015/0119206 | A1 * | 4/2015 | Newman | A63B 5/20 | 482/82 |
| 2015/0133277 | A1 * | 5/2015 | Alexandrov | A63B 21/4015 | 482/131 |
| 2015/0224355 | A1 * | 8/2015 | Holland | A61H 15/00 | 482/82 |

FOREIGN PATENT DOCUMENTS

| | | |
|---|---|---|
| WO | WO 2014/157850 A1 | 10/2014 |
| WO | WO 2017/031307 A2 | 2/2017 |

* cited by examiner

MULTIPURPOSE EXERCISE TRAINING DEVICE

CROSS-REFERENCE TO RELATED APPLICATIONS

This application claims the benefit and priority of U.S. Prov. Pat. App. Ser. No. 62/206,274 (filed Aug. 18, 2015) entitled "Multipurpose Exercise Training Device."

STATEMENT REGARDING FEDERALLY SPONSORED RESEARCH OR DEVELOPMENT

Not applicable.

FIELD OF THE INVENTION

The present invention relates to exercise devices, and in particular, to a multifunction jump rope and exercise device having an inelastic cord with two handles that is easily configurable for use in performing a wide variety of exercises.

BACKGROUND OF THE INVENTION

Physical fitness is commonly achieved by engaging in cardiopulmonary and resistance exercise training. Cardiopulmonary training improves the endurance and functional capacities of the body's cardiovascular and pulmonary systems. Sustained, repetitive body movement that elevates heart rate levels to between 50% and 85% of maximum typically achieves cardiopulmonary training. Resistance exercise training improves muscular strength. Resistance exercise training is achieved by exerting the muscles against an oppositional force, including but not limited to the force produced by other muscles, a source of elastic tension, pneumatic resistance, or by gravity. Resistance exercise devices allow a user to exercise their muscles by providing such resistance to the movement of a user's arms, legs, or torso. Adequate muscular strength training also includes the conditioning of opposing agonist-antagonist or "push-pull" muscle groups. The minimum guidelines for strength and endurance exercises recommended by the American College of Sports Medicine include at least 150 minutes of moderate-intensity cardiopulmonary exercise per week (30 minutes of exercise 5 days per week) and resistance exercise training of each major muscle group two to three days per week.

There are few portable products available on the market that can provide multiple modes of exercise training. Training to improve both cardiopulmonary and muscular fitness often requires a variety of exercises, which may demand a user to engage multiple fitness devices. Such equipment can be space consuming and immobile. For this reason, visitation to a fitness training facility, such as a gym, is often required for an adequate training bout. This can often be inconvenient or unobtainable. As a result, sufficient fitness training can become inaccessible to many people. Even those who maintain regular gym membership will often forgo exercising while travelling or when their regular schedule is otherwise disrupted. There are many products on the market that claim to offer a complete, whole-body workout. However, there are few portable products on the market that adequately and comprehensively condition both the cardiopulmonary and muscular systems.

There is a need to provide a multifunction, portable exercise device that makes endurance training and agonist-antagonist resistance training more convenient. Such a device would include adjustments to change configurations and facilitate a wide range of stances and exercises that provide resistance to the user's motion in a form that is useful for physical training. In addition, there is a need for the aforementioned device to be sufficiently portable such that it can be used in a variety of locations to allow for convenient exercise. Current multipurpose exercise equipment can be too large to be portable. Other exercise equipment, including, but not limited to other inelastic suspension systems, free-weights, stationary weight machines, elastic training systems, alternative resistance systems, the conventional jump rope, the treadmill, the stationary bicycle, and/or other endurance and resistance training equipment are often limited to stationary use and/or the scope of training that they can provide. Few alternative systems provide both muscular resistance and cardiopulmonary endurance training. Those that do provide muscular resistance training are often limited in the muscular groups that they exercise and/or lack the means to train complimentary agonist-antagonist muscle groups with the same device. The invention claimed here solves these problems.

SUMMARY OF THE INVENTION

The present invention solves the above-identified problems of known exercise devices by providing an inelastic device that can be used as a jump rope and easily transformed in configuration to a resistance training device that derives resistance from the force of gravity acting on the user's suspended body weight. When used for resistance training, the invention can provide resistance ranging from nearly zero to the full body weight of the user. The purpose of this invention is to produce one piece of exercise equipment that can service the user with a means to perform both cardiopulmonary training and resistance training, in the location of their choice.

In the subsequent description of particular preferred embodiments of the device, it is understood that the embodiment of any components are not limited by their syntax. In one embodiment, the present invention provides a jump rope comprising a flexible, inelastic member such as but not limited to a length of rope, cord, twine, or cable, be it braided or unbraided, coated or exposed. This member will henceforth be referred to as a "cord." In this embodiment, the cord has opposed longitudinal ends upon which clip assemblies are secured, and two handles are mounted along the cord. The handles are hollow with a circumferential lip protrusion around the internal circumference, located near the end of the handle facing the clip assemblies. The clip assemblies have complimentary female grooves on the external circumference of the section through which the cord passes such that the grooves interact with their complimentary circumferential lips on the handles such that the handles can be attached and detached from their respective clip assemblies. When a handle assembly is attached to a clip assembly, the circumferential orientation of the lip-groove joint allows for the additional advantage of rotational freedom such that the each clip assembly can swivel freely with respect to its handle. When a handle assembly is detached from a clip assembly, said handle can move freely along the length of the cord due to its hollow nature. The clip assemblies are composed of a section with the aforementioned groove as well as functional snap-hook clips, henceforth referred to as "clips," which can be secured to the opposite clip assembly or to the cord itself at designated locations. The device therefore allows the user to easily transform configurations to accommodate multiple modes of exercise.

The cardiopulmonary training configuration of the device is the jump rope configuration in which the clip assemblies are attached to the handles by way of the lip-groove joint such that a user can grip the handles and manipulate the device to make the cord rotate around his/her body to perform the jump rope exercise.

There are multiple resistance training configurations of the device that a user can use to perform resistance training exercises. One configuration will be referred to as the closed-loop resistance configuration, in which the clip assemblies are detached from their handles and secured to each other by means of the snap-hook clips. This creates a configuration in which the cord is orientated in a continuous, closed-loop such that the handles can be positioned on opposite ends of the loop. Another configuration will be referred to as the open-loop resistance configuration, in which at least one handle is detached from its respective clip assembly and secured to a point on the cord to form a D-shaped handle such that the device is still oriented as a longitudinal body but with the handles on opposing ends oriented perpendicular to the cord. Both the closed-loop and open-loop configurations can be draped over, wrapped around, or otherwise secured to an anchor point that can support the user's weight with the handles positioned on each side of said anchor point. Common anchor points include, but are not limited to a tree, staircase, crossbeam, or other natural or manmade structure. Resistance exercises are performed by pulling or pushing on one or both grips in a direction away from the anchor point, such that the user has to overcome the force of gravity to move his/her body in the opposite direction that he/she pulled or pushed. Different resistance exercises can be performed by augmenting the position and/or orientation of the user's body relative to the position of the handles and/or by altering the angle of the handles relative to the anchor point. The number of possible resistance training configurations is not limited to the aforementioned open-loop and closed-loop configurations. Due to the functional versatility of the snap-hook clips, users can create alternative configurations to meet their needs. The location of the snap-hooks on the endpoints of the cord also enables the user to attach compatible accessories to create further alternative configurations to satisfy different resistance exercise needs.

By providing a piece of exercise equipment that functions as a jump rope as well as a bodyweight resistance trainer, the exercise training device provides users with a versatile means of training both their cardiopulmonary and muscular capacities, respectively. The portable nature of the device allows the user to engage in a comprehensive workout in a larger variety of locations, and does not restrict its use to the confines of a conventional gym. The claimed invention differs from what currently exists. Currently, no other jump ropes can also provide users a means of gravity-derived resistance training. Furthermore, there are few resistance training devices that are also designed for endurance training. Other exercise devices that derive resistance training from suspension of the user's bodyweight do not provide a configuration designed specifically for repetitive movement conducive to cardiopulmonary training, as does the jump rope configuration of the present invention. This invention is an improvement to what currently exists because of its portability and multiple configurations. The combined offering of the jump rope and resistance training configurations of this portable model allows users to engage in multiple modes of exercise to achieve an adequate training bout at the location of their choice. The multipurpose functionality of this device eliminates the need for users to engage multiple exercise devices and/or the need to visit a training facility to achieve a complete training bout.

A feature of the present invention is the provision of a jump rope having a pair of handles, of a cord extending through and between the handles such that centrifugal force exerted on the cord when the handles are griped acts to swing the cord about the user's body for the purpose of jumping rope. In one embodiment, the handles are hollow with a lip-groove joint that attaches to clip assemblies, which are located on the endpoints of the cord, allowing said member to freely rotate inside the two hollow handles.

Another aspect of the present invention is to provide an exercise device that can be changed in configuration from a jump rope to a substantially inelastic resistance exercise device. In one attachment, this change in configuration is achievable by detaching at least one handle from its respective clip assembly and transforming the device to one of various resistance exercise configurations including, but not limited to a closed-loop or open-loop configuration.

Another aspect of the present invention is the provision of a portable exercise device that can be used freely as a jump rope and that can also be easily attached to an anchor point to be used for gravity-derived resistance exercises when the user pushes or pulls on one or both handles. This can provide a training bout of user determined setting and modality, as well as intensity, resistance, and effort.

Another aspect of the preferred embodiment of this invention is the provision of snap-hook clip assemblies attached to the endpoints of the cord of aforementioned device such that compatible accessories can be used in conjuncture to the device.

These features together with the various ancillary provisions and features which will become apparent to those skilled in the art from the following detailed description, preferred embodiments thereof being shown with reference to the accompanying drawings, by way of example only, wherein:

It is to be noted, however, that the appended figures illustrate only typical embodiments of the disclosed assemblies, and therefore, are not to be considered limiting in their scope, for the disclosed assemblies may admit to other equally effective embodiments that will be appreciated by those reasonably skilled in the relevant arts. Also, figures are not necessarily made to scale.

DETAILED DESCRIPTION OF THE INVENTION

Figure 4A:
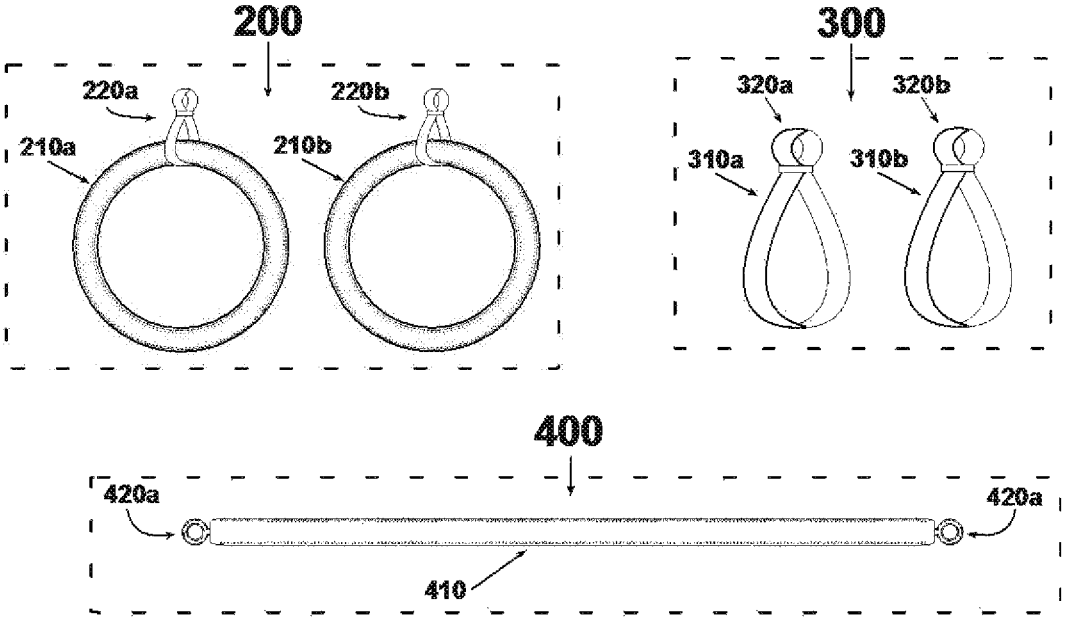
FIG. 4A illustrates examples of some accessories that are compatible with the multipurpose exercise training device and can be used in conjunction with the device to perform alternative exercises.
Figure 4B:
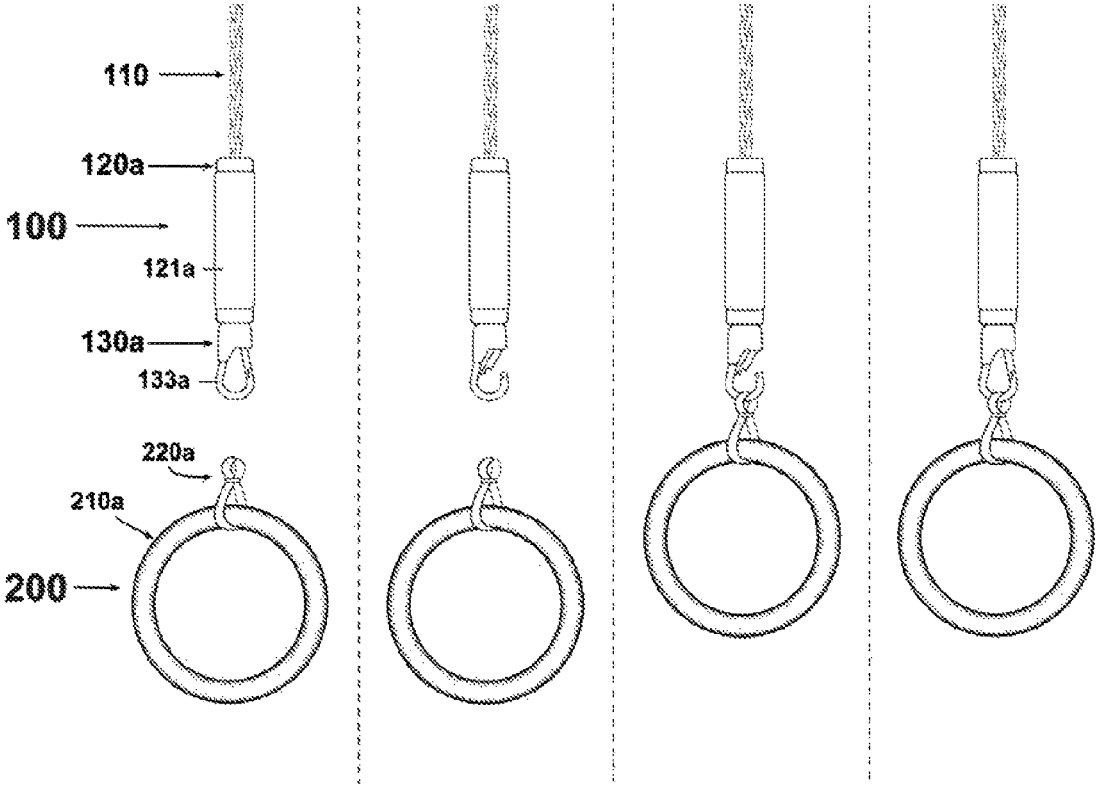
FIG. 4B is a partial schematic view of a method of attaching one particular compatible accessory to one of the clips located on the ends of the cord of the multipurpose exercise training device.
Figure 4C:
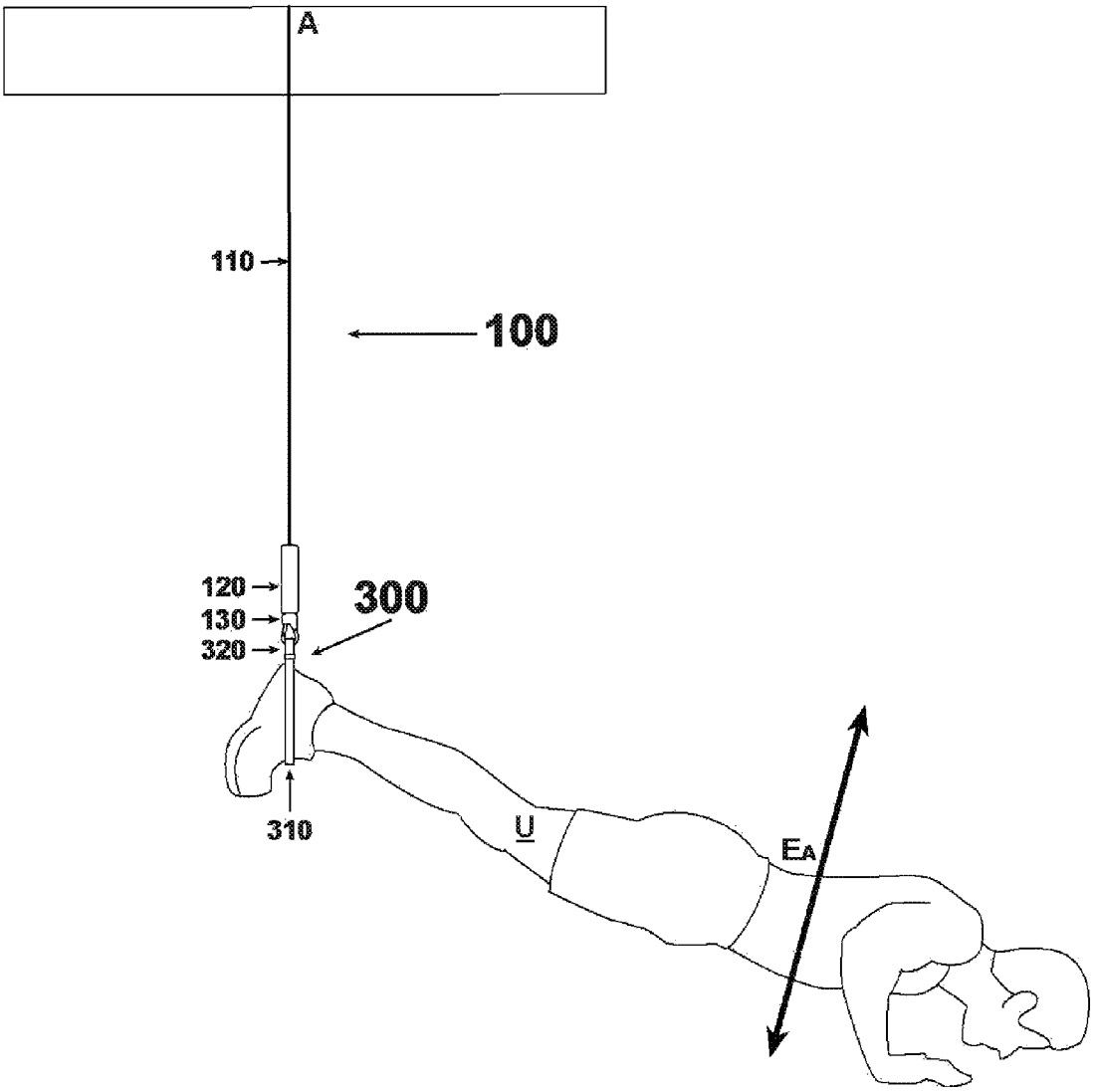
FIG. 4C is illustrative of an example of a user exercising with the multipurpose exercise training device using a compatible accessories secured to the clips located on the ends of the cord of the device.
Figure 5:
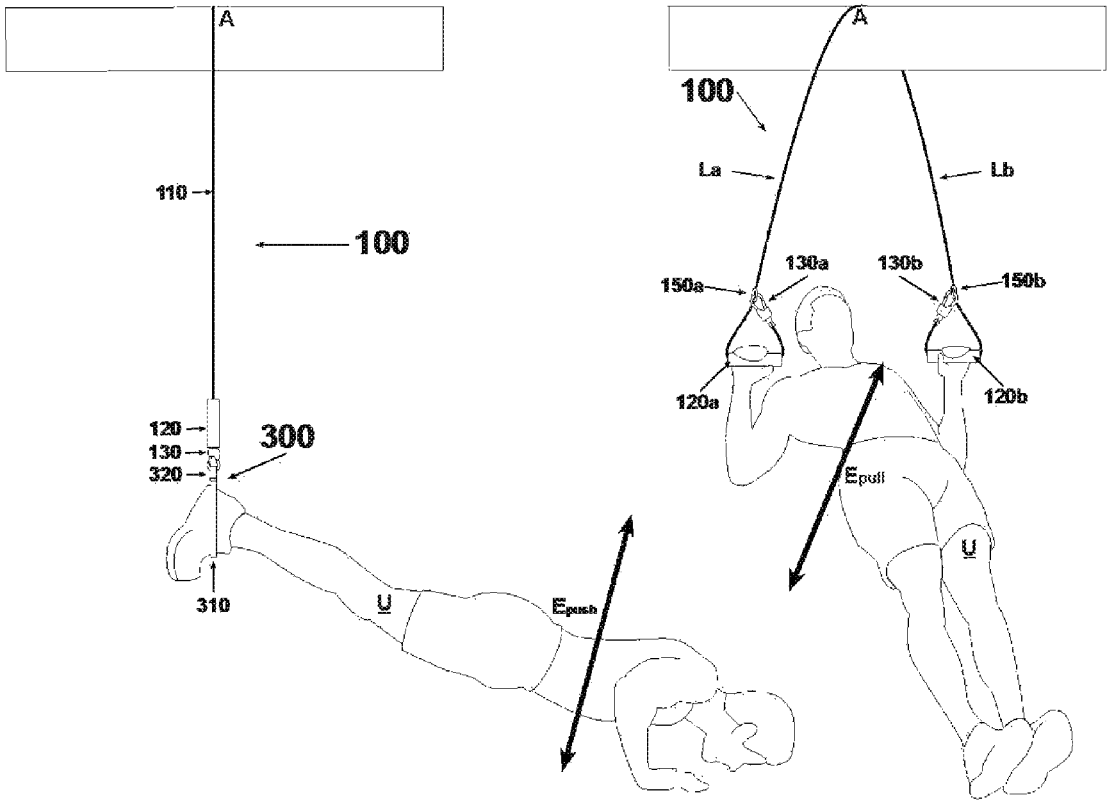
FIG. 5 is illustrative of an example of a user exercising with the device in a manner that conditions both agonists and antagonists of the pectoral girdle in the anteroposterior plane. Adequate agonist-antagonist training in this case is achieved by exercising the complimentary flexor and extensor muscle groups of the chest, back, shoulders, and arms.
Figure 6A:
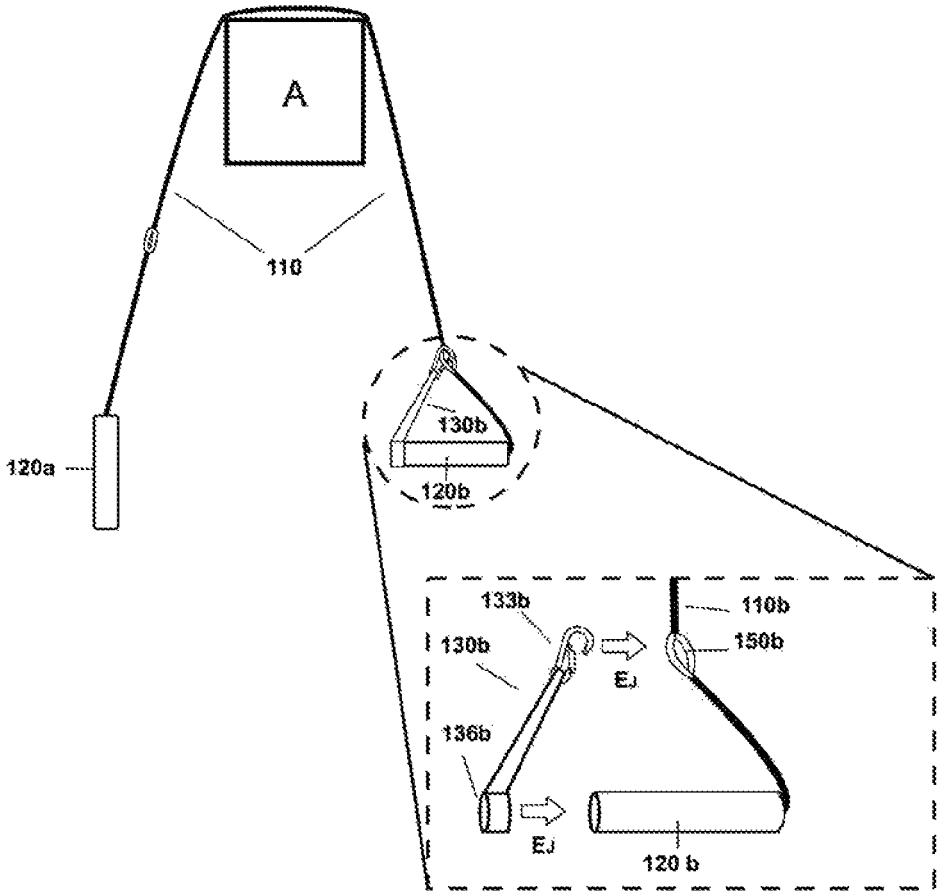
FIG. 6A is illustrative of an alternative embodiment, in which the multipurpose exercise training device is composed simply of a separate, rigid clip component that can be attached to a typical jump rope for the purpose of transforming the device into a suitable inelastic resistance training configuration.
Figure 6B:
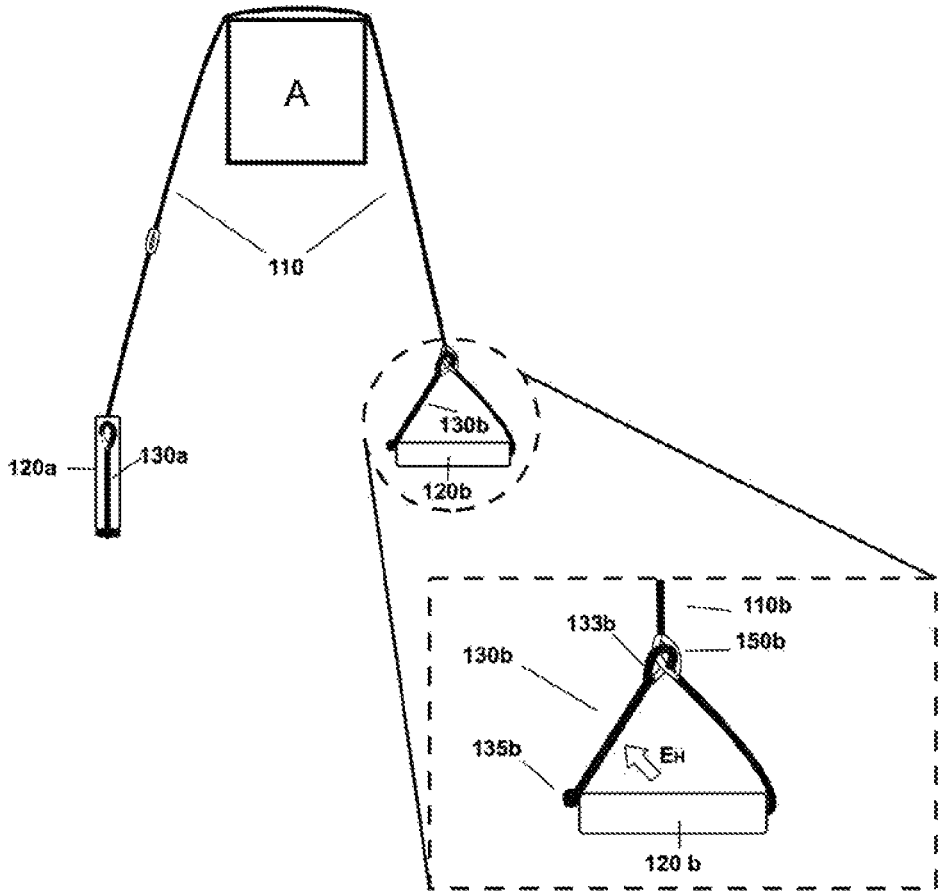
FIG. 6B is illustrative of an alternative embodiment, in which a rigid hook extension affixed to the grip can be used to manipulate the multipurpose exercise training device to create a handle with the purpose of transforming the device from a jump rope configuration to an inelastic resistance training configuration.
Figure 6C:
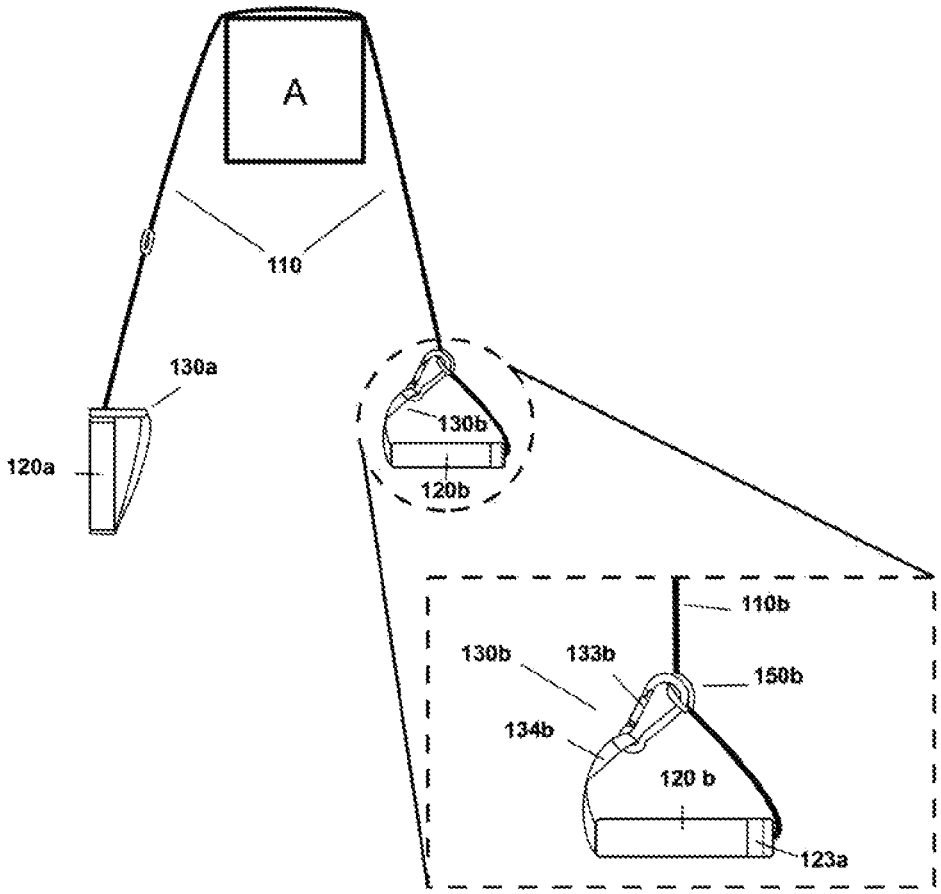
FIG. 6C is illustrative of an alternative embodiment, in which a permanently extended, permanently affixed, or retractable clip can be used to manipulate the multipurpose exercise training device to create a handle with the purpose of transforming the apparatus from a jump rope configuration to a resistance training configuration.
Figure 6D:
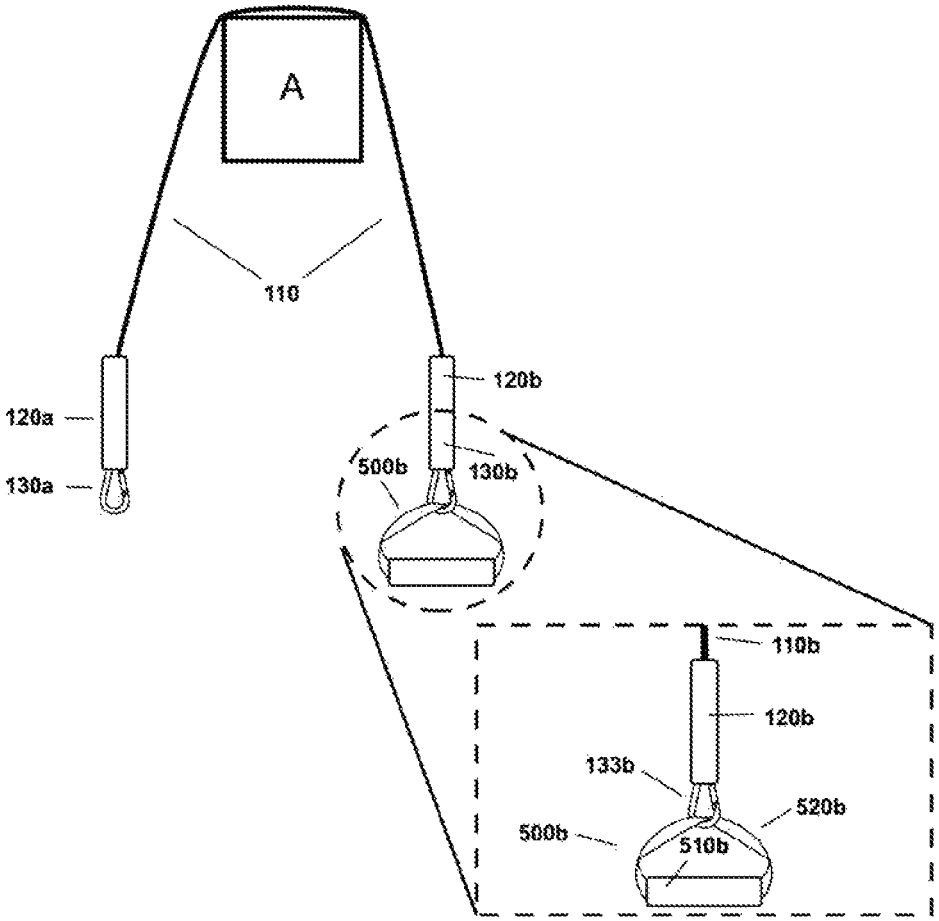
FIG. 6D is illustrative of an alternative embodiment, in which a clip is permanently affixed to the terminal end of the multipurpose exercise training device's handle, such that a separate handle accessory can be attached to the clip for the purpose of performing inelastic resistance training.
Figure 6E:
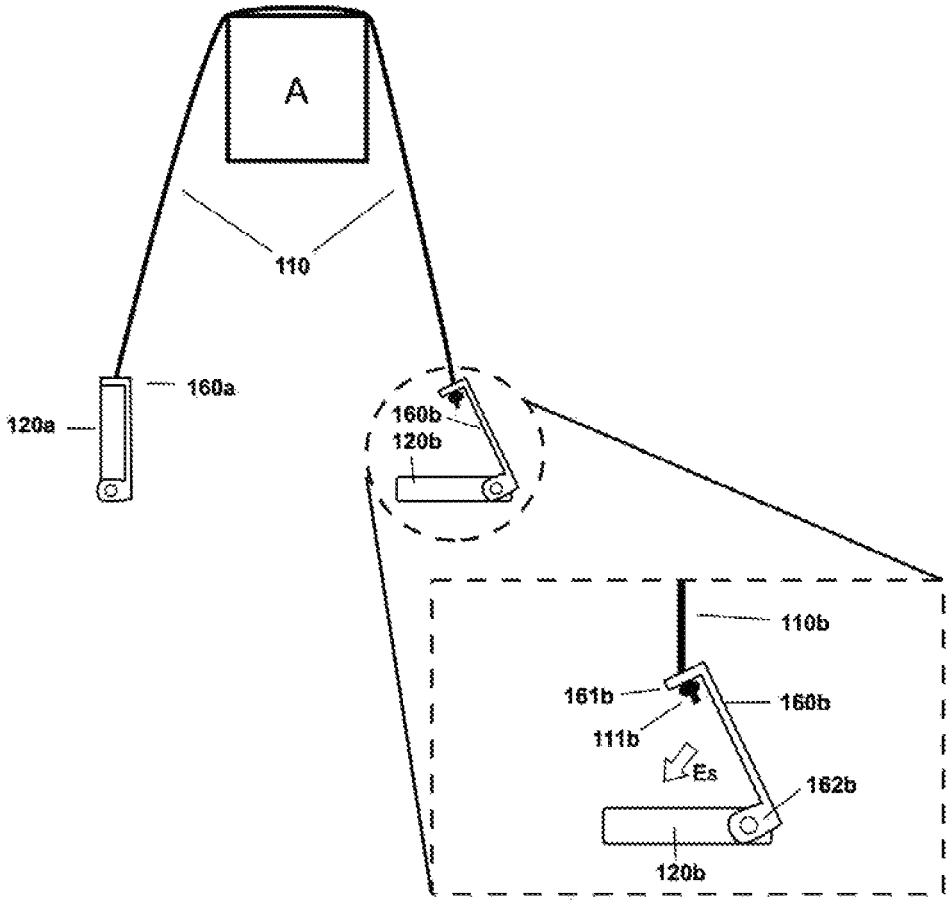
FIG. 6E is illustrative of an alternative embodiment, in which the handle of the multipurpose exercise training device is composed of two rigid parts that can hinge apart to a fixed angle to create a handle with the purpose of transforming the device from a jump rope configuration to an inelastic resistance training configuration.
Figure 6F:
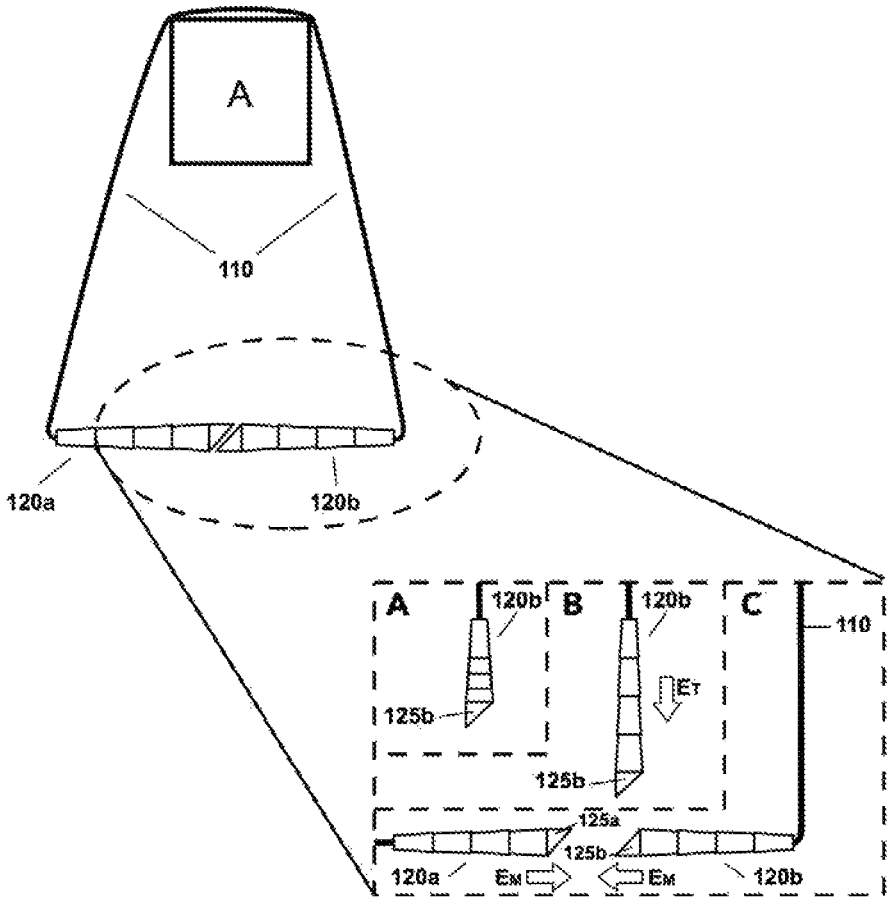
FIG. 6F is illustrative of an alternative embodiment in which the handles of the multipurpose exercise training device can be telescopically lengthened and attached to each other to create a continuous bar that the user can suspend from for the purpose of performing inelastic resistance training.

In general, the present invention provides an inelastic exercise device that can either be used as a jump rope or attached to a supporting structure or anchor point such that a user can perform a large number of exercises by balancing the device as the user transfers his/her weight to the device and/or by using the handles of the device to move his/her body against the force of gravity. Several of the features of the present invention will now be illustrated with reference to FIGS. 1-5, which show the set-up and use of a preferred embodiment of the device, and which are not meant to limit the scope of the present invention. FIGS. 1A-D demonstrate the set-up, mechanics, and use of the device in the jump rope configuration. FIGS. 2A-D demonstrate the set-up, mechanics, and use of the device in a closed-loop resistance configuration. FIGS. 3A-D demonstrate the set-up, mechanics, and use of the device in an-open loop configuration. FIGS. 4A-C illustrate some examples of accessories that are compatible with the present invention, including the set-up, and use of said accessories in conjunction with the device. FIG. 5 is a demonstration of an example of a user exercising with one embodiment of the device to train complimentary agonist and antagonist muscle groups. FIGS. 6A-F are illustrative of a number of alternative embodiments for the present invention.

In general, in one embodiment, the exercise device 100 includes a longitudinal cord 110 having a pair of handles 120 and clip assemblies 130 located on the terminal ends of the cord 110. In one embodiment, the handles 120 of the device 100 are hollow such that they can move along the length of the cord 110. The cord 110 is substantially flexible and inelastic and may be, but is not limited to, a length of rope, cord, twine, or cable. The cord 110 is preferably in a four-part rounded braid, however, any manner of braided or unbraided cord known to one of skill in the art may be used, and the cord 110 may be coated or exposed. In one embodiment, the device 100 may also have a flexible, protective sleeve 140 located on the cord to protect the cord 110 from abrasion and other stresses. The cord 110 may also have protective loopholes 150 that serve as designated points of attachment between a clip 133 and the cord 110. The handles 120*a*,120*b* of the device may also have grip paddings 121*a*,121*b* for the comfort of the user. In an alternative embodiment, the handles 120 may consist of different weights, for example, each handle 120 may be 5 pounds to increase the difficulty of exercising. The aforementioned elements that are composed as pairs are indicated as a first handle 120*a* and a second handle 120*b*, a first clip assembly 130*a* and a second clip assembly 130*b*, and a first loophole 150*a* and a second loophole 150*b*.

Figure 1A:
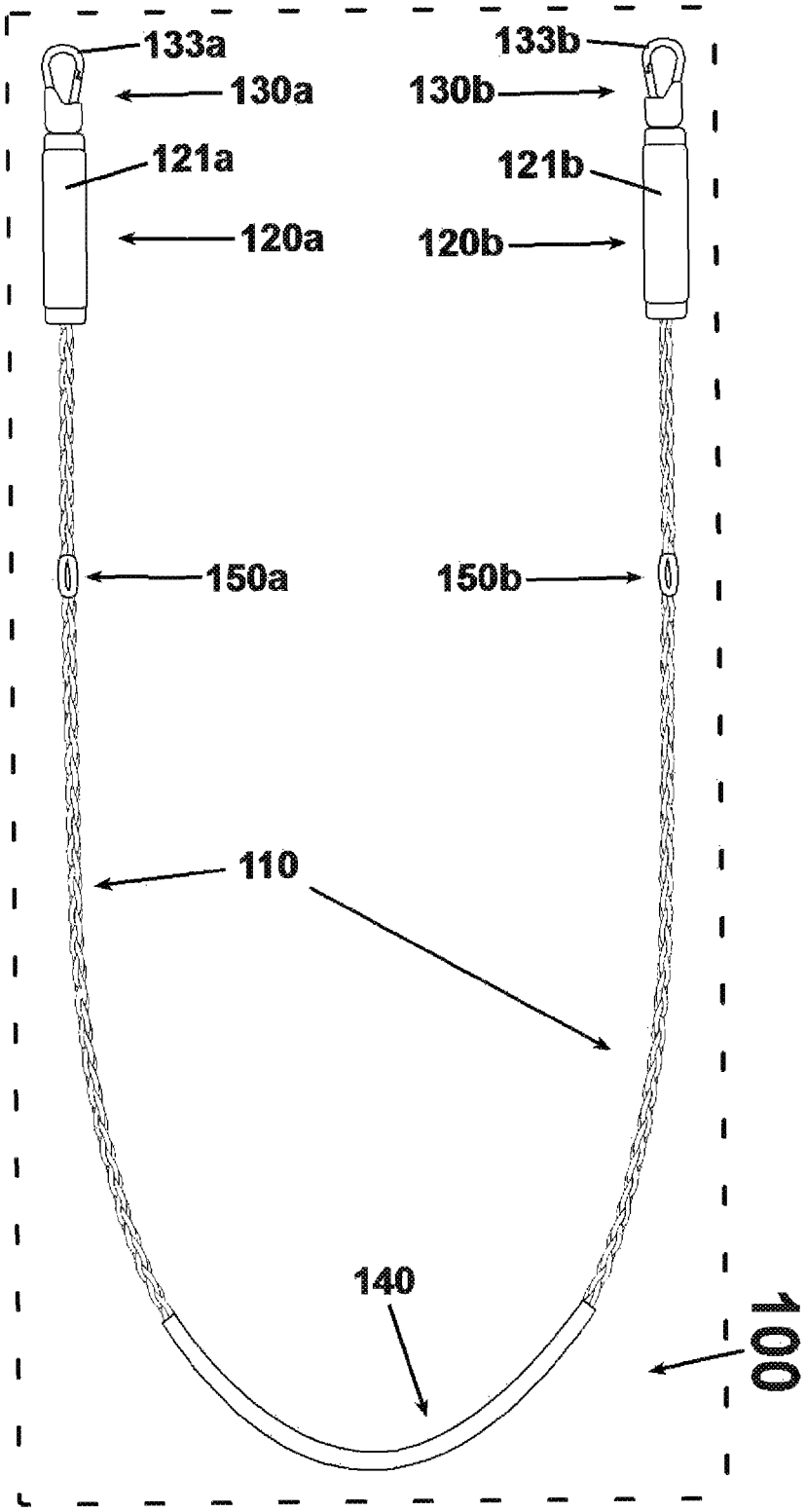
FIG. 1A is a front view of one embodiment of the multipurpose exercise training device in a jump rope configuration.
Figure 1B:
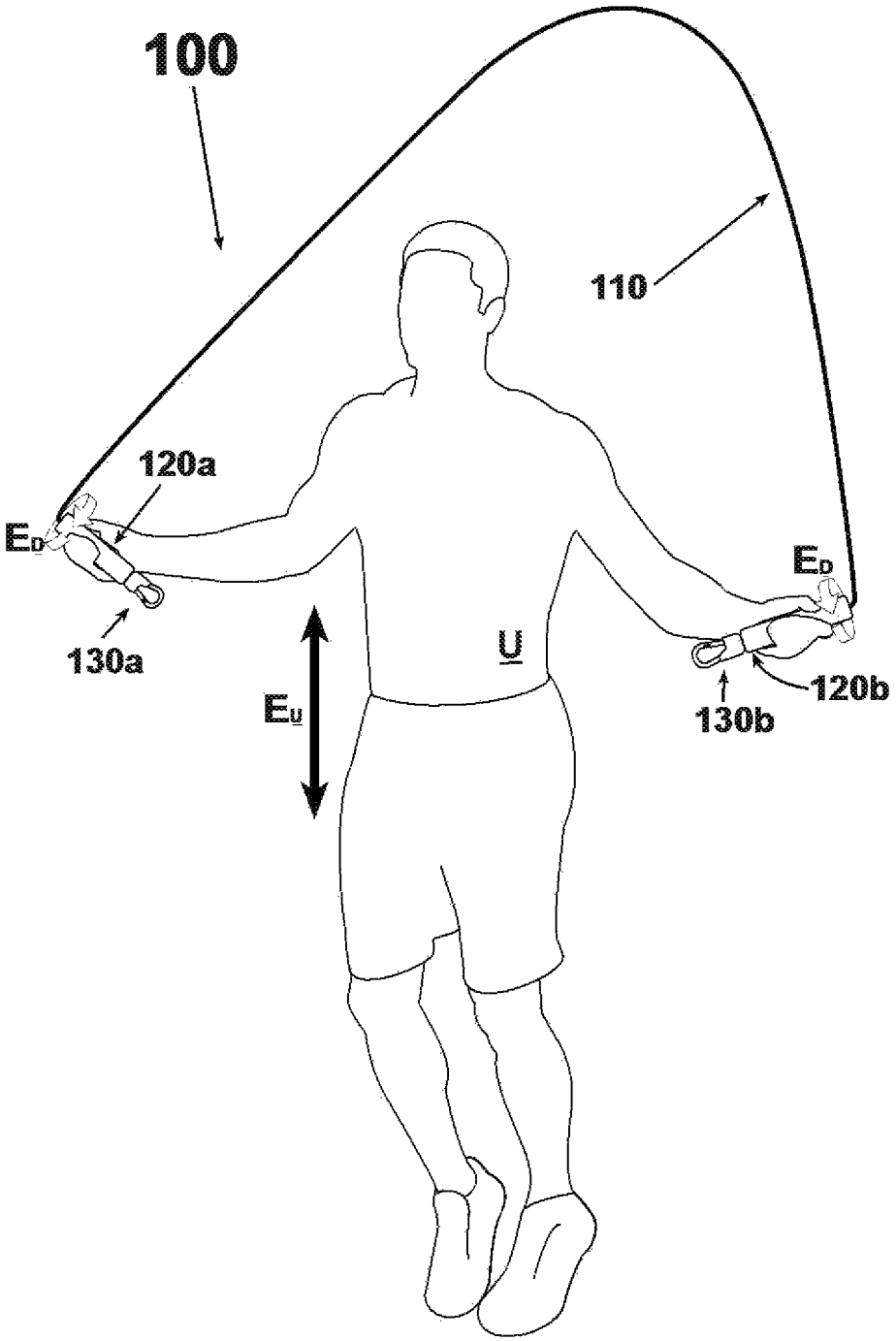
FIG. 1B is a perspective of a user exercising with the multipurpose exercise training device in jump rope configuration detailed in FIG. 1A.

FIG. 1A is front view of the device 100 in jump rope configuration wherein the cord 110 extends between the two handles 120 that are attached to the clip assemblies 130. FIG. 1B is illustrative of a user U exercising with the device 100 in said jump rope configuration. The user U grips the handles 120 and exerts a centrifugal force ED on the cord 110 such that the cord 110 rotates around the user U in the sagittal plane. The user U jumps $E_U$ up and over the cord 110 as it passes under his/her feet to avoid interrupting the continuous motion of the cord 110. This repetitive nature of the jumping motion $E_U$ and centrifugal force ED exerted by the user U provides an adequate mode of exercising the cardiopulmonary capacity of the user U.

Figure 1C:
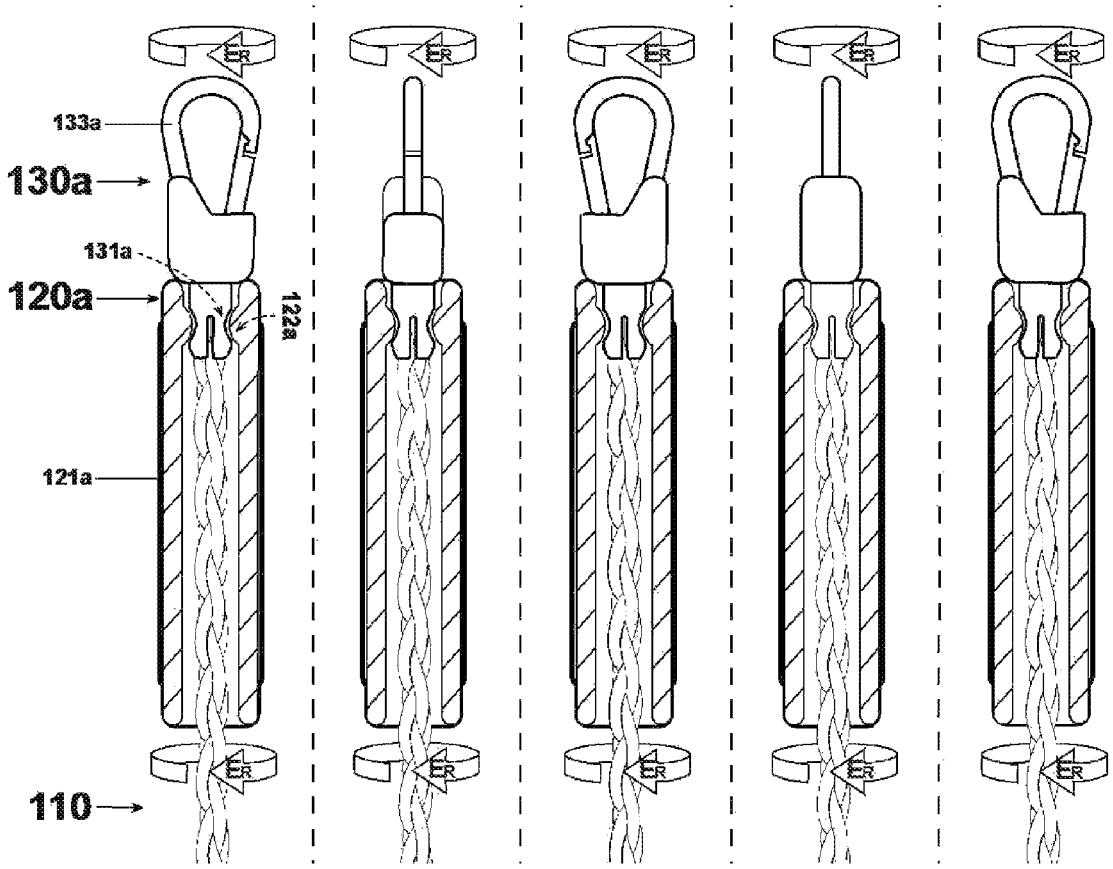
FIG. 1C is a cross-sectional view of the swiveling articulation capability of multipurpose exercise training device's lip-groove joints between the clip assemblies and the handles of the device.

The clip assemblies 130 of the device 100 may consist of a clip 133, which may be a snap-hook clip or a similar clip fitting, and a section that has a female groove 131. A clip 133 may be comprised of other attachment or securing means, such as carabiners, hooks, clasps, catches, or other configurations that permit removably secure assembly to loopholes or another attachment or securing means. FIG. 1C is a partial schematic sectional view showing details of the swiveling articulation capability of device's 100 lip-groove joints between a clip assembly 130*a* and a cross-sectional view of a handle 120*a* of the device. When a clip assembly 130*a* is attached to its handle 120*a*, the female groove 131*a* of the clip assembly compliments the circumferential lip protrusion 122*a* such that the clip assembly 130*a* and attached cord 110 can freely rotate ER within the handles 120*a*.

Figure 1D:
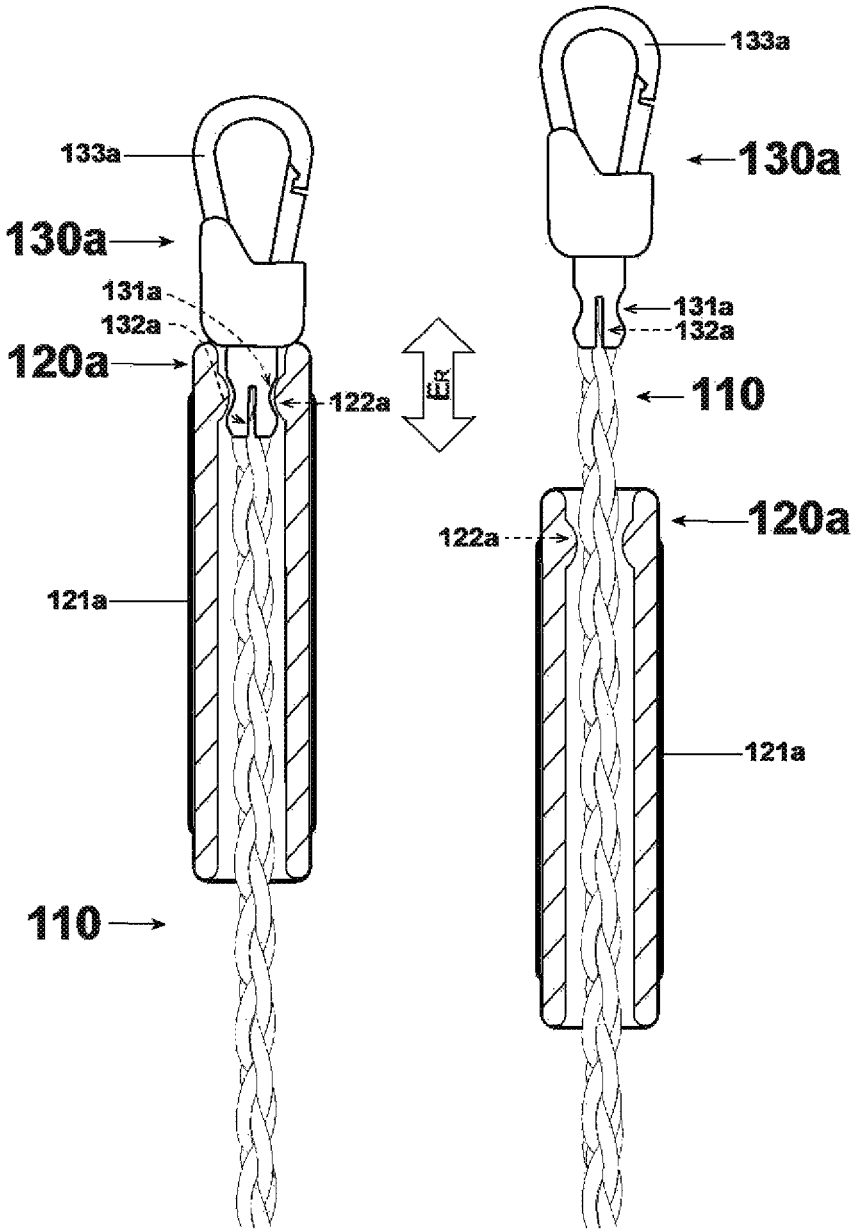
FIG. 1D is a cross-sectional view of the attachment/detachment articulation capability of multipurpose exercise training device's lip-groove joints between the handles and the clip assemblies of the device.

FIG. 1D demonstrates the method of attaching and detaching a handle 120 from its respective clip assembly 130 by means of another interaction between the female groove 131 and the circumferential lip protrusion 122. In this illustration, the handle 120 is viewed from a cross-sectional perspective. Slotted gaps 132 on the section of the clip assembly 130 with the groove 131 allow said section to articulate like a living hinge. These gaps 132 allow the groove 131 to flex inwards and shrink in radius such that when it is inserted or extracted $E_M$ into or from the handle 120 it can pass through the radius of the circumferential lip protrusion 122. After this section of the clip assembly 130 is fully inserted $E_M$ into the handle 120, the groove 131 section of the clip assembly 130 will return to its original shape and radius, providing a semi-secure fit between the clip assembly 130 and the handle 120. This serves to secure the clip assemblies 130 to their handles 120 such that these components do not separate unintentionally while a user U is performing jump rope exercises as seen in FIG. 1B due to the centrifugal force ED applied to the invention. The semi-secure fit between the clip assemblies 130 and the handles 120 can be overcome by the user U by manually applying an extracting force $E_M$ due to the flexible nature of the section with the female groove 131 previously attributed to the slotted gaps 132. The ability to intentionally separate the clip assemblies 130 and the handles 120 allows the user U to transform the device into other configurations.

In an alternative embodiment, the semi-secure fit between the clip assembly 130 and handle 120 may be defined by a ball bearing assembly at the terminal ends of the handle 120. In this alternative embodiment, the cord 110 may pass through a rubber cone component on the clip assembly 130. This rubber cone component may be used to provide a friction fit inside of the ball bearing joint allowing for both free rotation and detachability between a handle 120 and its respective clip assembly 130.

Figure 2A:
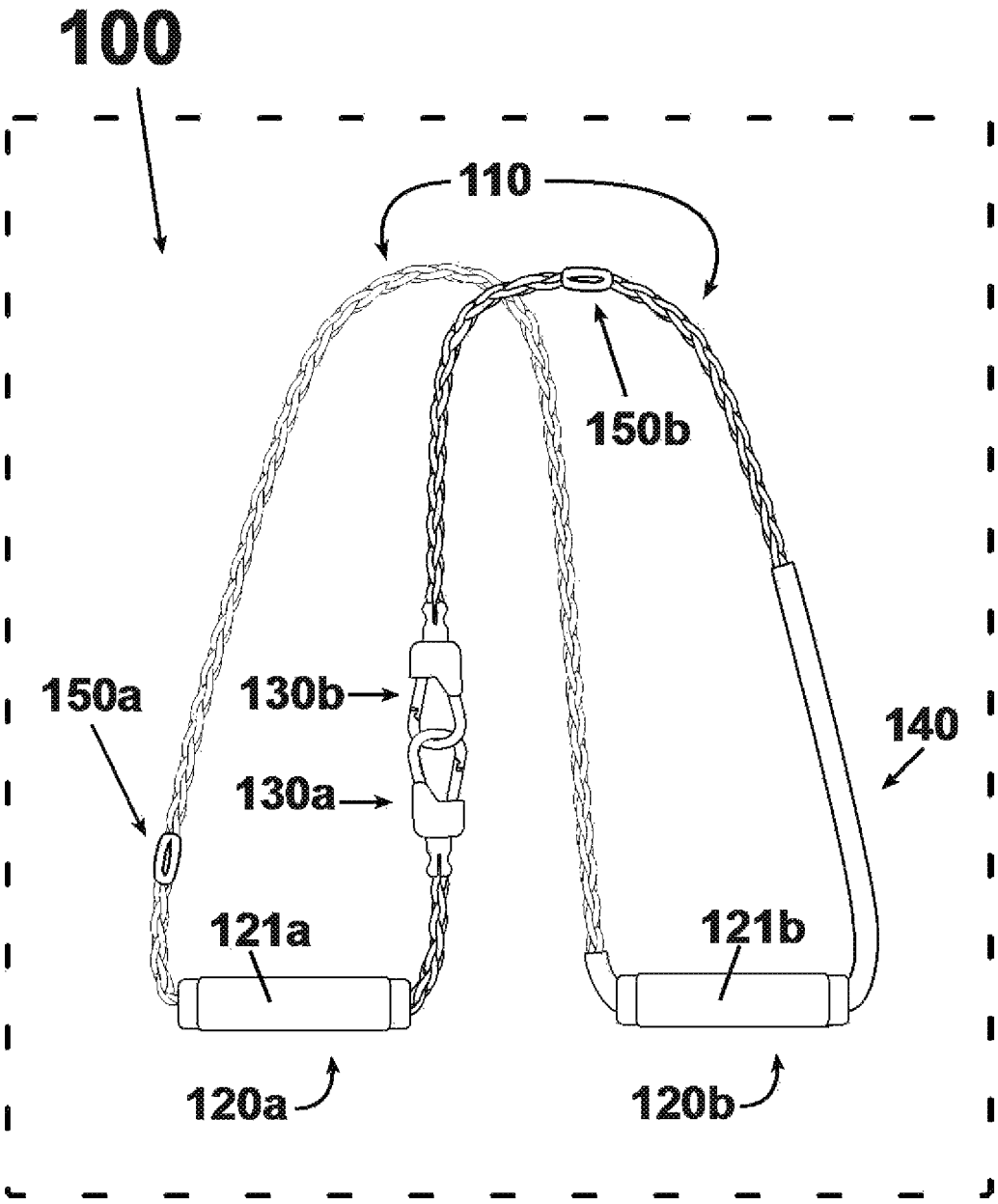
FIG. 2A is a perspective view of one embodiment of the multipurpose exercise training device in a closed-loop resistance configuration.

When the two handles 120 are detached from the clip assemblies 130 and secured to each other, the cord 110 becomes a closed-loop on which the handles 120 can be positioned at any point along the length of the cord 110 such that the device 100 can be used to suspend the bodyweight of a user from an anchor point to perform resistance training exercises. FIG. 2A is a perspective view from an angled perspective of said closed-loop configuration. In this configuration, the handles 120 have been detached from their respective clip assemblies 130 for the purpose of attaching the first clip assembly 130*a* to the second clip assembly 130*b*. The device 100 is folded along the midpoint of the loop such that the handles 120*a* and 120*b* are suspended on opposite ends of the loop created by the cord 110.

Figure 2B:
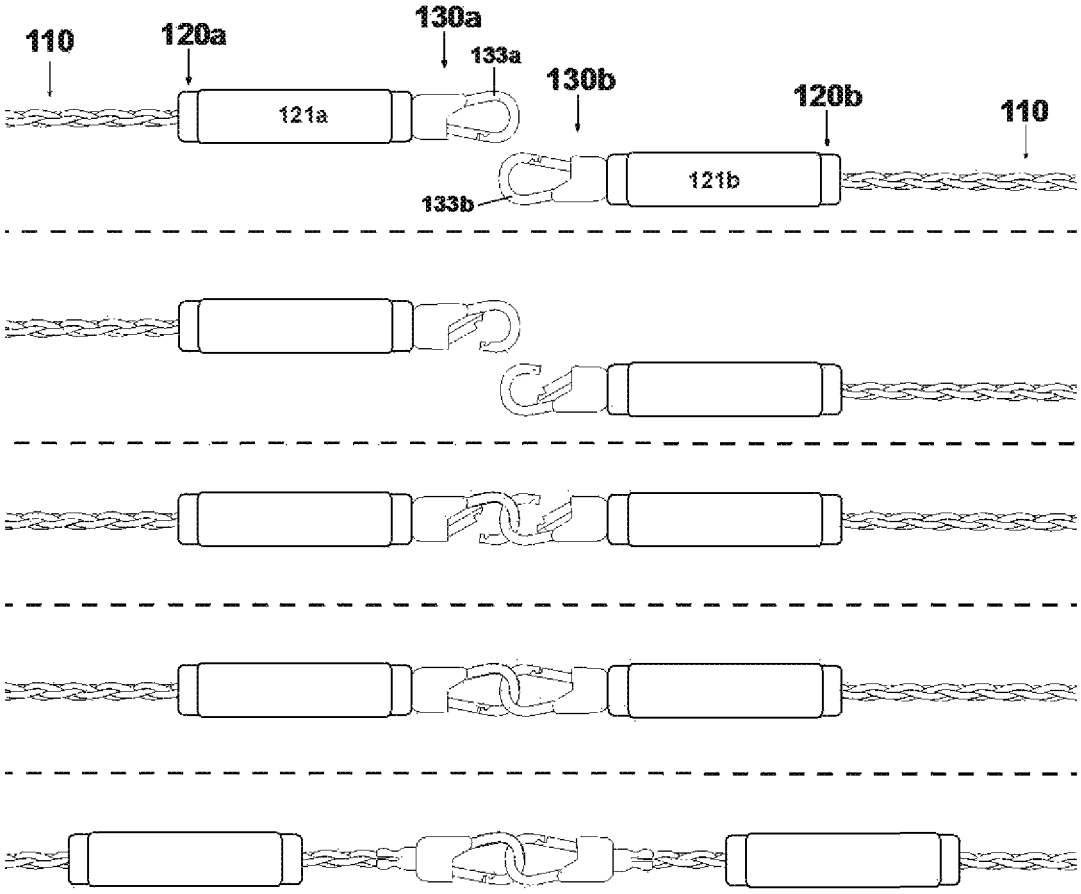
FIG. 2B is a partial schematic sectional view of a method of transforming the multipurpose exercise training device into a closed-loop configuration.
Figure 2C:
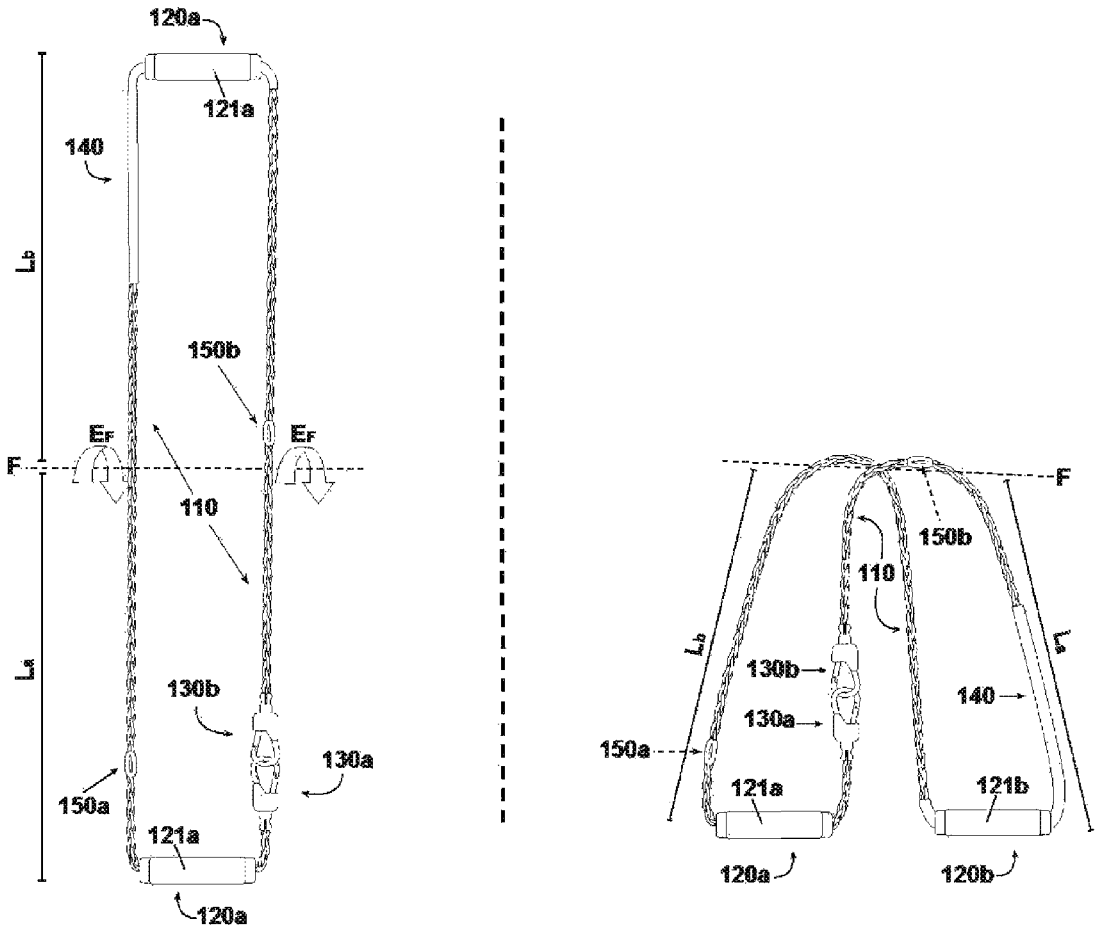
FIG. 2C is a schematic detailing a method of manipulating the closed-loop configuration of the multipurpose exercise training device into an appropriate position for use during resistance exercises.

FIGS. 2B-C detail the transformations required to configure the device 100 in said closed-loop orientation. With respect to FIG. 2B, a partial schematic sectional view of the device 100 demonstrates a method of creating the loop by detaching the clip assemblies 130 from the handles 120 and securing the clips 133 together. By one method, the clips 133*a* and 133*b* are positioned adjacent to each other and subsequently clipped together. Once a link between clips 133*a* and 133*b* has been secured, the handles 120*a* and 120*b* can be pulled apart from their respective clip assemblies 130*a* and 130*b* as previously demonstrated in FIG. 1D to be repositioned along the cord 110. FIG. 2C is a schematic detailing the next steps associated with configuring the device 100 in a suitable orientation such that the closed-loop can be draped over an anchor point. The handles 120*a* and 120*b* are positioned on opposite ends of loop. The device is then folded $E_F$ along fold axis F such that it creates two equal lengths $L_A$ and $L_B$ on opposite sides of fold axis F, with handles 120*a* and 120*b* on the bottom of lengths $L_A$ and $L_B$, respectively. The device 100 can then be draped from an anchor point A at the location of axis F.

Figure 2D:
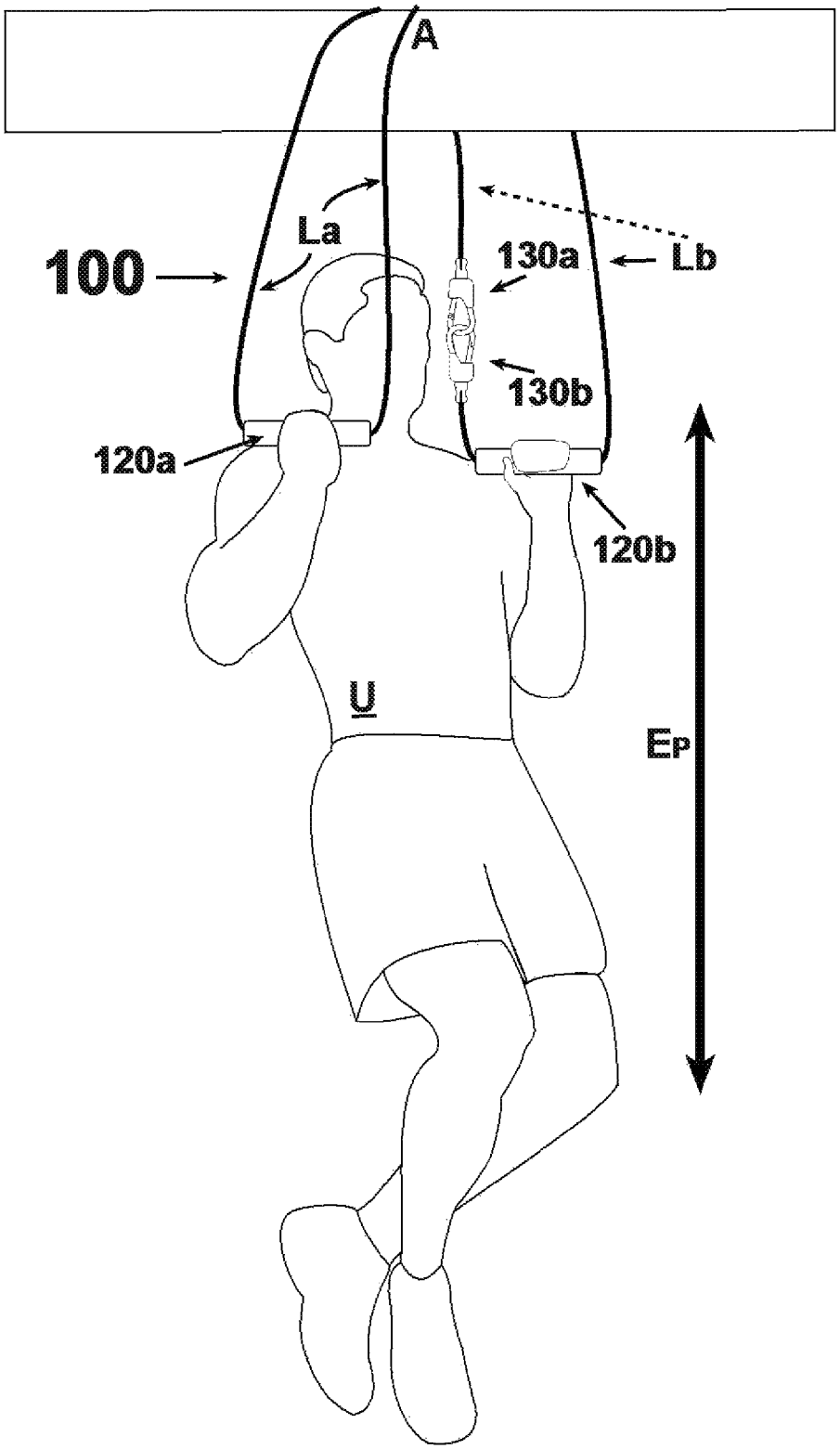
FIG. 2D is illustrative of an example of a user exercising with the multipurpose exercise training device in the closed-loop resistance configuration detailed in FIG. 2A.

With reference to FIG. 2D, an example of a user U is shown in one of the many exercise positions that can be performed when the closed-loop configuration is suspended from an overhead anchor point A. In particular, FIG. 2D demonstrates a user U engaging in pull-up exercise with the device 100 draped over the anchor point A. This set-up includes equidistant lengths $L_A$ and $L_B$ of the cord 110, each suspending a handle, 120*a* and handle 120*b* on opposite sides of the anchor A. After gripping handles 120*a* and 120*b* with his/her hands, the user can exert himself/herself upwards by pulling down equally on handles 120*a* and 120*b* to concentrically raise or eccentrically lower $E_P$ his/her body against the force of gravity.

Figure 3A:
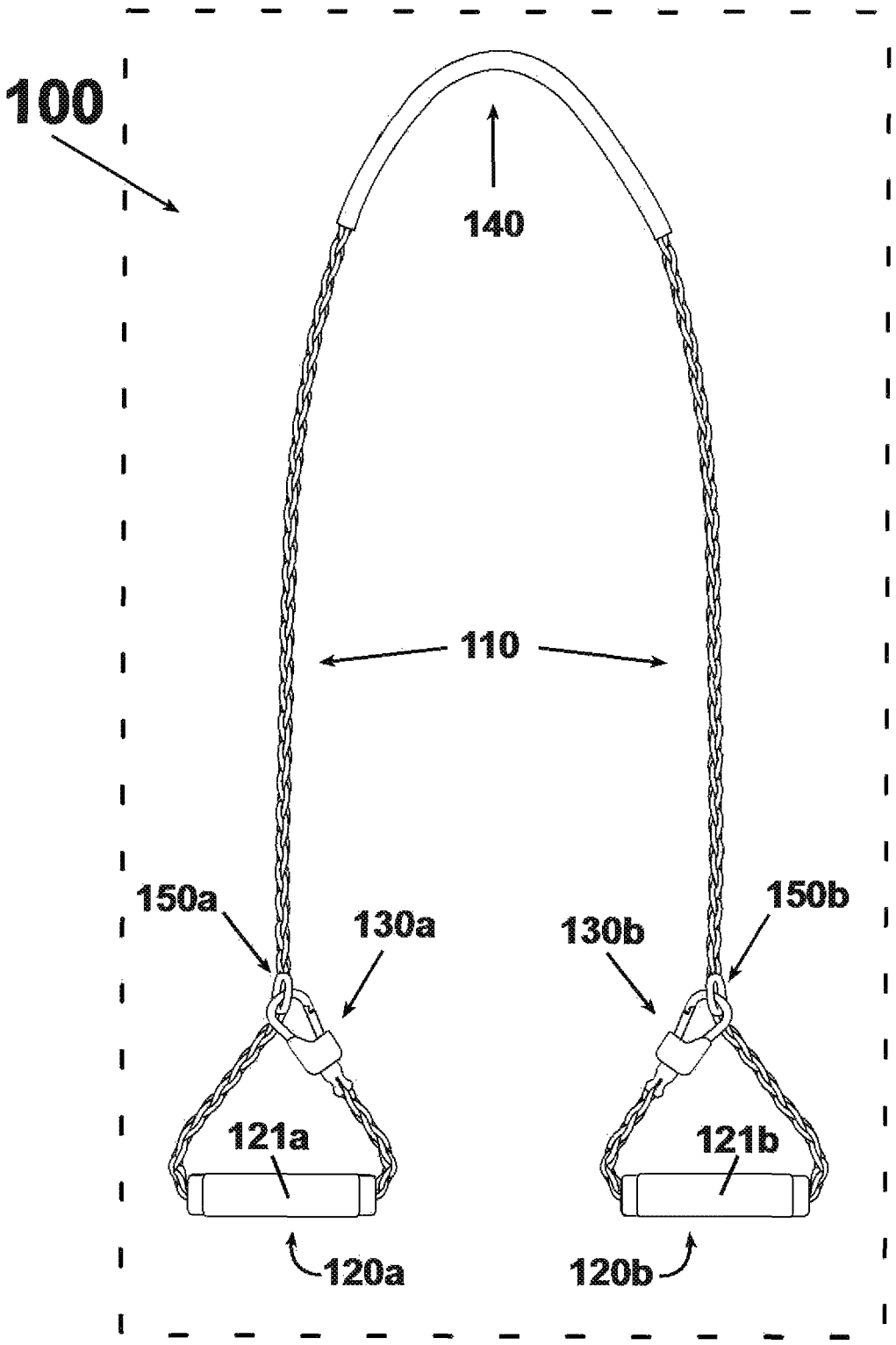
FIG. 3A is a front view of one embodiment of the multipurpose exercise training device in an open-loop resistance configuration.

FIG. 3A is a schematic front view of another embodiment of the device 100 in an open-loop configuration also suitable for resistance training. In said configuration, the clip assemblies 130 are clipped to designated protective loopholes 150 on the cord 110. This open-loop configuration maintains the longitudinal nature of the cord 110 while positioning the handles 120 perpendicular to the longitude of the cord 110 such that a user can pull or push the handles 120 while suspending their bodyweight. A loophole 150 can be any mechanism that allows for an attachment or securing a clip 133 to a point on the cord to form a handle in an open-loop configuration, such as, but not limited to, a hook, an opening in a braid or a cord, a clamp, a clip, creating a knot or loop in the cord, or any other securing mechanism. In a preferred embodiment, this attachment to a loophole 150 or other attachment mechanism would fashion a D-shaped handle, although other shapes of handle are contemplated.

Figure 3B:
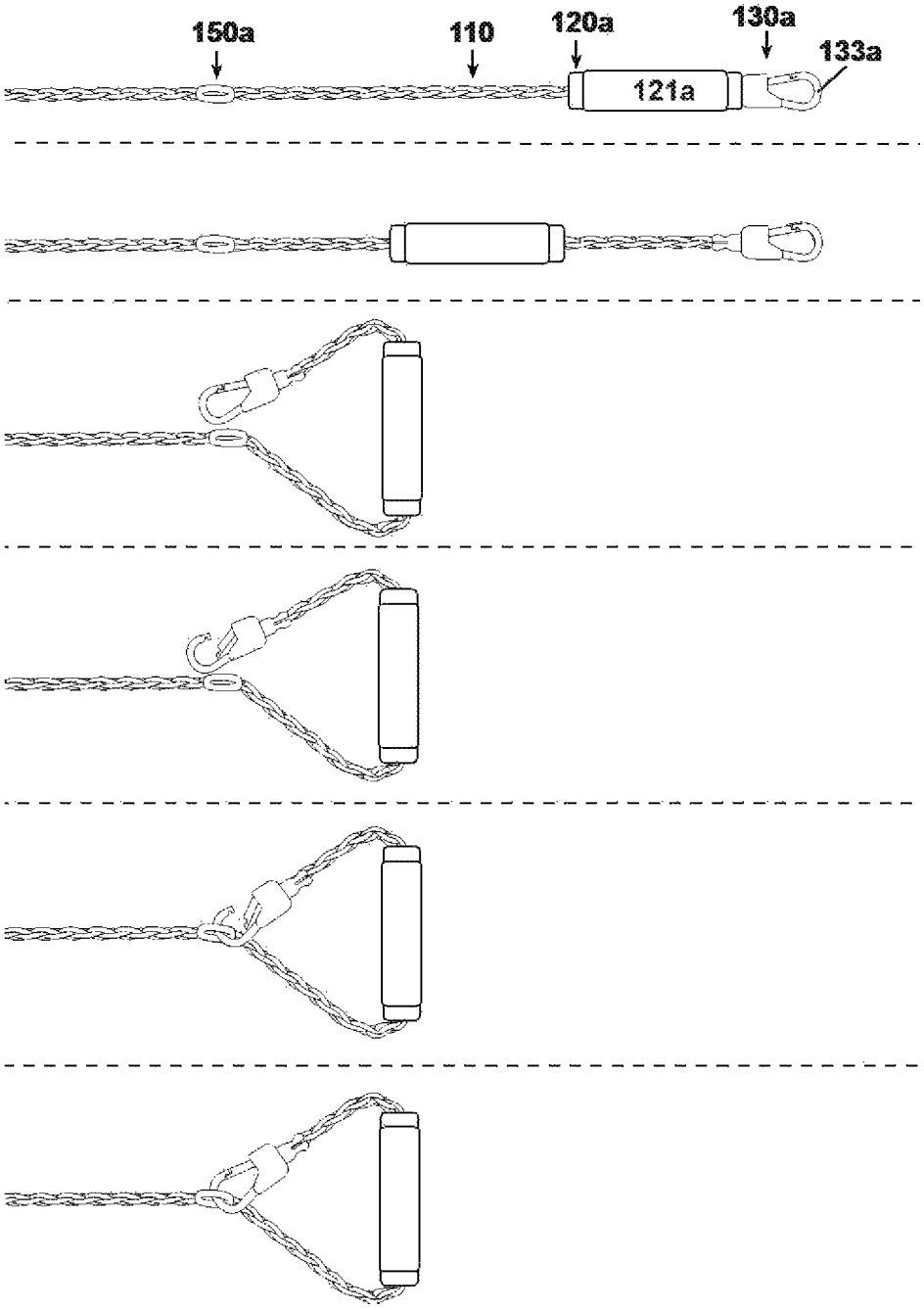
FIG. 3B is a partial schematic view of a method of transforming one end of the multipurpose exercise training device into an open-loop configuration.
Figure 3C:
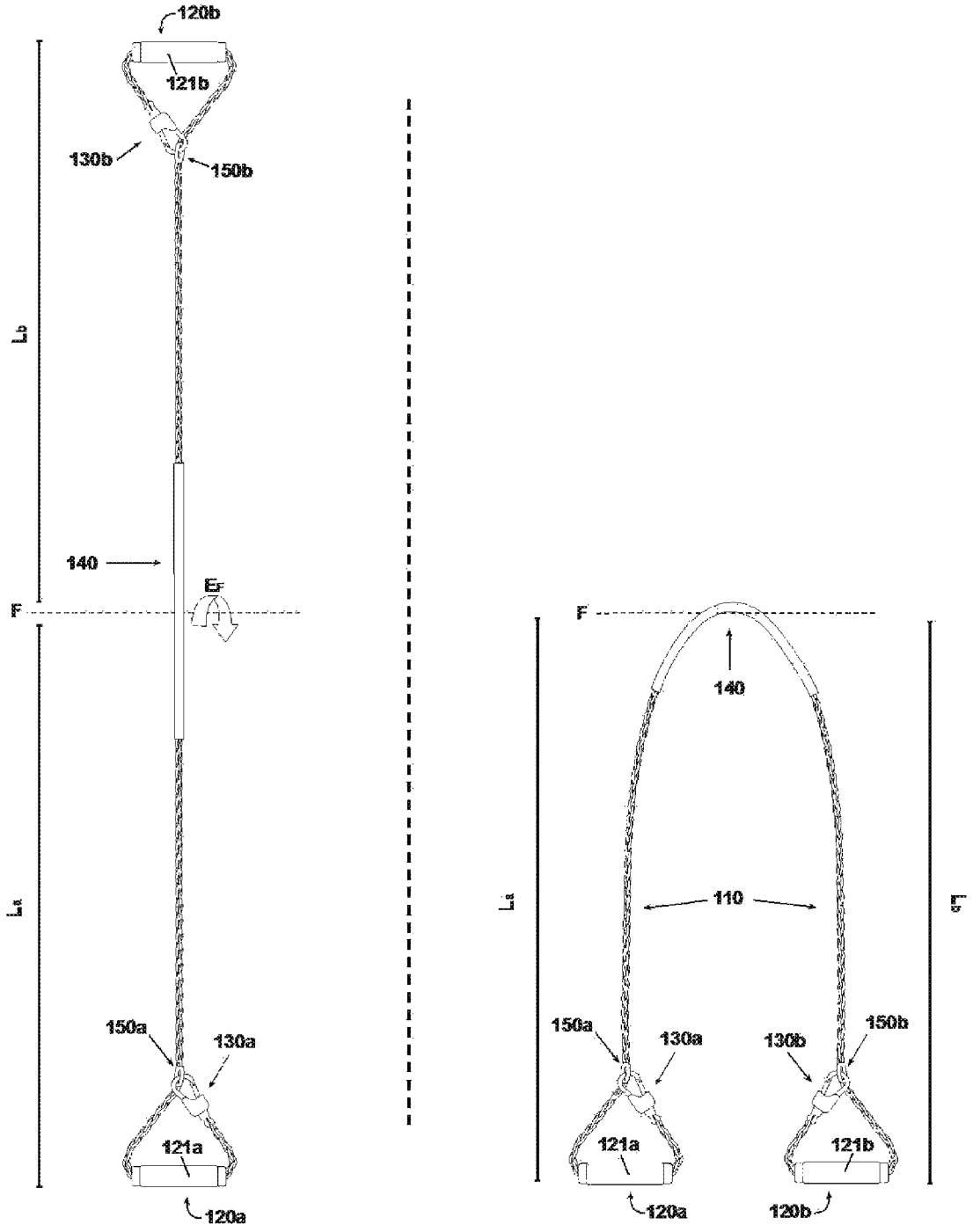
FIG. 3C is a schematic view of a method of manipulating the open-loop configuration of the multipurpose exercise training device into an appropriate position for use during resistance exercises.

FIGS. 3B-C detail the transformations required to configure the device 100 in an open-loop orientation. With respect to FIG. 3B, a partial schematic sectional view of the device 100 demonstrates a method of securing a clip 133*a* to a loophole 150*a* to set up a handle 120*a* in a D-shaped handle orientation such that the handle 120*a* can be pulled or pushed when the device 100 is suspended. By one method, the clip assembly 130*a* is positioned adjacent to the loophole 150*a* after the handle 120*a* has been detached from the clip assembly 130*a* as demonstrated in FIG. 1D such that the handle 120*a* may be repositioned on the cord 110 between its respective clip assembly 130*a* and loophole 150*a*. The clip 133*a* section of the clip assembly 130*a* is placed through and securely linked to the loophole 150*a*. The result of this transformation may be a D-shaped handle orientation, wherein the handle 120*a* may be substantially perpendicular to the length of the cord 110 such that a user can pull or push the handle 120*a* to move his/her body in the direction of the cord 110. Such a D-shaped handle orientation may accommodate a user's hands or feet for a particular exercise. Once links between both clips 133*a* and 133*b* have been secured with their respective loopholes 150*a* and 150*b*, the device 100 is folded over $E_F$ along at the midpoint of the cord 110 along axis F, as demonstrated in FIG. 3C. This creates a suitable orientation such that the cord 110 can be draped over an anchor point. The handles 120*a* and 120*b* are positioned on opposite ends of loop from two equal lengths $L_A$ and $L_B$ on opposite sides of fold F. The device 100 can then be draped from an anchor point A at the location of axis F. An anchor point may be any structure that allows the cord 110 to be draped over or through it, wherein there is an obstacle between the cord 110 and the user, such as a beam, a bar, a ring, a plank, a clip, a door anchor, a mount or any other structure known to one of skill in the art. In an alternative embodiment, the device can be configured for one handed use, wherein the handles are positioned on one side of an anchor point.

Figure 3D:
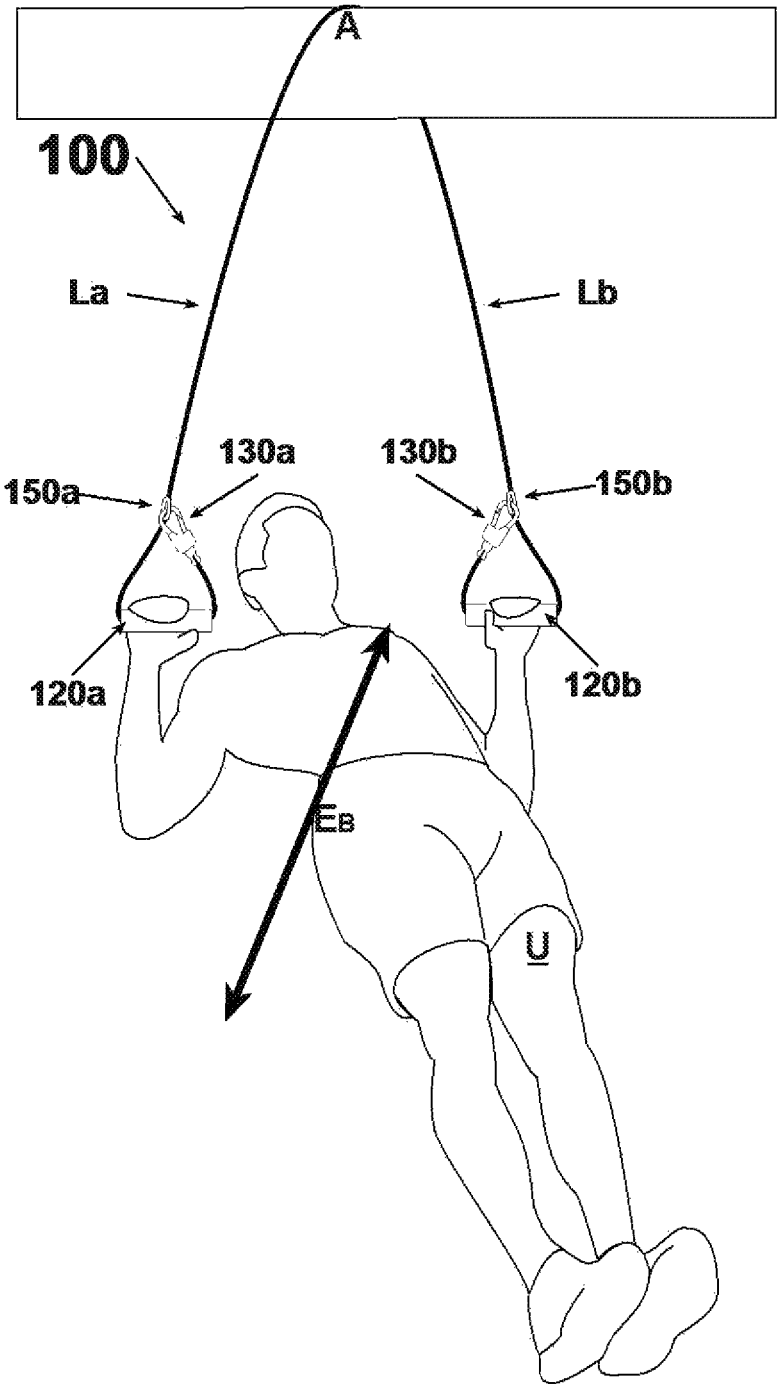
FIG. 3D is illustrative of an example of a user exercising with the multipurpose exercise training device in an open-loop resistance configuration.

With reference to FIG. 3D, an example of a user U is shown in one of the many exercise positions that can be performed when this open-loop configuration is draped over anchor point A. In particular, FIG. 3D demonstrates a user U engaging in back-row exercise with the device 100. This set-up creates equidistant lengths $L_A$ and $L_B$ of the cord 110, each suspending a handle 120*a* and handle 120*b* on opposite sides of the anchor A. In a similar fashion previously discussed with respect to FIG. 2B, by gripping handles 120*a* and 120*b* with the user's hands, and having his/her feet on the floor and/or another platform, the user can exert himself/herself upwards by pulling down equally on the handles 120 to concentrically raise or eccentrically lower $E_B$ his/her body against the force of gravity.

As previously explained, the closed-loop and open-loop configurations as illustrated in FIGS. 2-3 are two of many possible resistance training configurations of the device 100. In the current embodiment, among other possible configurations, it is also possible for a user to perform alternative exercises using compatible accessories that can be secured to the clips 133 or to other components of the device 100. Some examples of compatible accessories are illustrated in FIG. 4A. It is understood that there are many other possible accessories that can be secured to the clips 133, and that such accessories are not limited to the examples represented in FIG. 4A. With reference to FIG. 4A, three examples of compatible accessories are illustrated, including ring-grips 200, foot straps 300, and a bar-grip 400. The ring-grips 200 pictured have torus-shaped grips 210*a,b* and eyeholes 220*a,b* with which the clips 133 of the present invention 100 can be linked for use. Foot straps 300 may include foot loops 310*a, b* of flexible material as well as eyeholes 320*a,b* with which the clips 133 of the device 100 can be linked for use. A bar-grip 400 may include a rigid cylinder or bar 410 with eyeholes 420*a,b* located on either end for linkage with the clips 133 of the device 100.

FIG. 4B is a partial schematic view of a method of attaching a compatible accessory to a clip assembly 130*a* of the device 100. In this case, a ring-grip 200 is used as an example to illustrate a method of attachment. By one method, the clip assembly 130*a* is positioned adjacent to the eyehole 220*a* of the accessory 200. The clip 133*a* is opened, and inserted into the eyehole 220*a* to create a secure link. A similar method of attachment may be enlisted to attach the accessories 300 and 400 to the device 100 using their similar eyeholes 320 and 420. When secured to the clip assemblies 130 of the device 100, users can use ring grips 200, a bar-grip 300, or similar accessories, as alternative grips to perform particular resistance exercises. When foot straps 300 or similar accessories are secured to one or both clip assemblies 130 of the device 100, users can suspend one or both feet from the device 100 to perform particular resistance exercises.

FIG. 4C illustrates an example of a user U performing a resistance exercise using an accessory. In this case, foot-straps 300 are used as an example of an accessory in use. In particular, FIG. 4C demonstrates a user U engaging in a decline pushup exercise with the device 100. By one method, once the eyeholes 320 of the accessory 300 are linked with the clips 133, and the device 100 is draped over an anchor point in a similar set-up previously illustrated in FIG. 3B-D, the user U can insert his/her feet in the foot loops 310 to suspend his/her legs. With his/her feet elevated, the user U can press against the floor to concentrically raise or eccentrically lower EA his/her body against the force of gravity. By elevating his/her feet to perform the decline pushup, a user can increase the load against which he would exert in a regular pushup and gains the ability to exercise targeted muscle groups.

With reference to FIG. 5, an example of a user U exercising with the device in a manner that conditions both agonists and antagonist muscle groups of the pectoral girdle is illustrated to demonstrate the benefit of agonist-antagonist training. Pushups exercise the extensor muscle groups of the pectoral girdle in the anteroposterior plane. While pushups can be performed without the device 100, by using the device 100, the user U gains the ability to vary the resistance and muscles targeted with a pushup exercise, as demonstrated in FIG. 4C. Importantly, the device 100 also allows the user to exercise the opposite, antagonist flexor muscle groups of the pectoral girdle. When an individual does not exercise both the agonist and antagonist muscles of a joint, he/she can develop imbalanced muscle tone, which can lead to postural problems, and eventually a decrease in muscular strength. By using the device to perform both a push $E_{push}$ exercise using the chest, shoulders and arms and a pull $E_{pull}$ exercise using the back, shoulders, and arms, the user can maintain healthy, balanced muscle tone across the aforementioned joints.

There are a number of alternative embodiments of clip assemblies 130 that can accomplish the desired result of converting the device 100 from a jump rope configuration to a suitable inelastic resistance training configuration in which the user can perform strength training exercise by raising his/her bodyweight, suspended from an overhead anchor point, against the force of gravity. One embodiment, referring to FIG. 6A, there may be a separate, rigid clip assembly 130*b* comprised of a clip 133*b* and attachment means 136*b* that may be attached to the handle 120*b* by connecting the attachment means 136*b* with the handle 120*b* and fixing the clip 133*b* to a loophole 150*b* to create a handle configuration suitable for resistance exercises. Another embodiment, referring to FIG. 6B, the clip assembly 130*b* may employ a rigid hook extension with a hook 133*b* that is fixed to the handle 120*b* by an attachment means 135*b*, wherein the hook 133*b*, permanently affixed to the handle 120*b* may be hinged away from the handle 120*b* hooked to a loophole 150*b*, resulting in a D-shaped handle orientation. In an alternative embodiment, referring to FIG. 6C, a clip assembly 130*b* may be a permanently extended, permanently affixed or retractable element 134*b* extending from the handle 120*b* with a clip 133*b* that may be clipped into a loophole 150*b* to form a D-shaped handle orientation. In an alternative embodiment, referring to FIG. 6D, a clip 133*b* may be affixed to a handle 120*b* and a separate handle accessory 500*b* with resistance handle 510*b* may be clipped to the clip 133*b* of the device 100 via an attachment means 520*b*, which may be, but is not limited to, a loop or a ring in a similar fashion as depicted in FIG. 4B. Other accessories such as rings, foot loops, and bars may be attached to the clip 133*b*. In another embodiment, referring to FIG. 6E, the handles may be composed of two rigid parts 120*a,b* and 160*a,b* that have joints 162*b* so that the handles 120*a,b* can hinge and pivot around the joint 162*b* to a fixed angle. Still referring to FIG. 6E, the handle may have a point of attachment 161*b* with a central bore to receive the terminal end of the cord 110*b*, wherein the handle is prevented from detaching from the cord 110 by a securing point 111*b*. In an alternative embodiment, referring to FIG. 6F, the handles 120 may be telescopically lengthened and attached to each other via attachment means 125*a*, 125*b*, constituted by but not limited to a mechanical or magnetic components of a mating joint, at the terminal ends of the handles 120*a*, 120*b* to create a continuous bar that the user can use for the purpose of performing resistance training.

The multipurpose exercise training device 100 includes the provision of a versatile piece of exercise equipment that can be used to perform jump rope as well as various muscular training exercises by deriving resistance from the suspension of a user's bodyweight. No other jump rope provides a user the ability to exercise complimentary agonist-antagonist muscle groups by this manner. It is understood that while the exercise device 100 and accessories 200, 300, 400 have been described with respect to particular embodiments, there are many alternative embodiments that are within the scope of the present invention. It is also understood that the exercises performed with the device 100 that have been described and illustrated do not represent all the possible exercises that can be performed with the device 100, and many alternative exercises are possible due to the ability of the user to change the configuration of the device 100 and the position of his/her body to meet his/her needs.

Other features will be understood with reference to the drawings. While various embodiments of the method and apparatus have been described above, t should be understood that they have been presented by way of example only, and not of limitation. Likewise, the various diagrams might depict an example of an architectural or other configuration for the disclosed method and apparatus, which is done to aid in understanding the features and functionality that might be included in the method and apparatus. The disclosed method and apparatus is not restricted to the illustrated example architectures or configurations, but the desired features might be implemented using a variety of alternative architectures and configurations. Indeed, it will be apparent to one of skill in the art how alternative functional, logical or physical partitioning and configurations might be implemented to implement the desired features of the disclosed method and apparatus. Also, a multitude of different constituent module names other than those depicted herein might be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning including, "without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "module" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

The claims filed herewith are incorporated by reference in their entirety into the specification as if fully set forth herein.

I claim:

1. An exercise apparatus comprising:

a jump rope operationally configured to transform into a bodyweight suspension training device:

wherein the jump rope is further defined by:

an inelastic cord that is continuous between two terminal ends;

two clip assemblies;

where a first of the two clip assemblies is affixed to a first of said two terminal ends of the inelastic cord, and where a second of the two clip assemblies is affixed to a second of the two terminal ends of the cord;

a first substantially hollow handle that is rotatably and selectively detachable from said first clip assembly via a lip-groove joint;

a second substantially hollow handle that is rotatably and selectively detachable from said second clip assembly via a lip-groove joint; and where the inelastic cord is strung through both of said first and second substantially hollow handles.

2. The exercise apparatus of claim 1, wherein the clip assemblies are clipped to one another so that the first and second terminal ends of the cord are effectively coupled and a closed-loop resistance configuration is created and used as a resistance training device, wherein the handles are detached from the respective clip assemblies and each movable along the closed loop over a first and second loophole.

3. The exercise apparatus of claim 1, wherein the clip assemblies comprise a rigid hook extension affixed to a handle.

4. The exercise apparatus of claim 1, wherein the clip assemblies are permanently attached to a handle.

5. The exercise apparatus of claim 1, wherein the clip assemblies are defined by at least one rigid shaft, wherein one shaft may rotate around an axis to form a fixed angle.

6. A method of exercising comprising:

obtaining a jump rope comprising an inelastic cord that is continuous between two ends, a first loophole attachment point disposed through the cord at a first interval, a first clip assembly on a first end of the cord and a second clip assembly on a second end of the cord, wherein a first handle is strung through by said cord and rotatably and selectively detachable from the first clip assembly, and wherein a second handle is strung through by said cord and rotatably and selectively detachable from the second clip assembly;

wherein the cord is braided and said first loophole is between two braids of the braided cord;

manipulating the jump rope into a bodyweight suspension training device by placing a portion of the jump rope on an anchor point;

suspending a portion of a user's bodyweight from the handles; and, performing a resistance training exercise.

7. The method of claim 6, wherein the step of manipulating the jump rope into a suspension training device is further defined by attaching the first and second clip assemblies together to form a closed-loop resistance configuration, and further comprising the steps of:

detaching the first and second handles from the respective clip assemblies;

maneuvering said first and second handles to be on opposite sides of the closed-loop resistance configuration, wherein the maneuvering is accomplished at least in part by threading said first loophole through said first handle; and, hanging the first and second handles on opposite sides of the anchor point.

8. The method of claim 6, wherein the step of manipulating the jump rope into a suspension training device is further defined by the steps of:

attaching at least one clip of the first clip assembly to the first loophole attachment point to create a D-shaped handle, wherein the first handle may be detached from the first clip assembly and maneuvered along the cord so that the orientation of the first handle is substantially perpendicular to the length of the cord such that a user can pull or push the handle.

9. An exercise apparatus comprising:

an inelastic cord with a first end and a second end opposite to the first end, where the inelastic cord is continuous between the first and second ends;

a first and second clip assembly fixed at said first and second opposite ends of the cord respectively;

a first handle disposed along the first end of the inelastic cord, wherein the first handle is substantially hollow and strung through by the inelastic cord;

a second handle disposed along the second end of the inelastic cord, wherein the second handle is substantially hollow and strung through by the inelastic cord;

wherein the first of said handles is rotatable and selectively detachable from the first clip assembly; and, at least one clip attachment point disposed through the cord, where the first clip assembly is attached to create a handle loop of the first handle.

10. The apparatus of claim 9, wherein the cord is a braided design and the clip attachment point is defined between braids of said braided design.

11. The apparatus of claim 10, wherein at least one substantially hollow protective sleeve is disposed along the cord.

12. The apparatus of claim 11, wherein the first and second clip assembly may attach and detach from clip attachment points along the cord.

* * * * *